US005279336A

United States Patent [19]

Kusakari et al.

[11] Patent Number: 5,279,336

[45] Date of Patent: Jan. 18, 1994

[54] WIRE BINDER

[75] Inventors: Ichiro Kusakari; Keishiro Murayama; Hiroshi Hanagasaki; Tsutomu Yoshida, all of Tokyo, Japan

[73] Assignee: Max Co., Ltd., Tokyo, Japan

[21] Appl. No.: 2,496

[22] Filed: Jan. 6, 1993

[30] Foreign Application Priority Data

| | | | |
|---|---|---|---|
| May 21, 1992 | [JP] | Japan | 4-40685[U] |
| May 21, 1992 | [JP] | Japan | 4-40686[U] |
| May 21, 1992 | [JP] | Japan | 4-40687[U] |
| May 21, 1992 | [JP] | Japan | 4-154483 |
| Sep. 1, 1992 | [JP] | Japan | 4-67131[U] |

[51] Int. Cl.[5] ..... B21F 9/02

[52] U.S. Cl. ..... 140/57; 140/119

[58] Field of Search ..... 140/57, 93 A, 119

[56] References Cited

U.S. PATENT DOCUMENTS

| | | | |
|---|---|---|---|
| 4,252,157 | 2/1981 | Ohnishi | 140/119 |
| 4,834,148 | 5/1989 | Muguruma et al. | 140/57 |
| 4,947,902 | 8/1990 | Lehmann et al. | 140/93 A |
| 4,953,598 | 9/1990 | McCavey | 140/57 |
| 5,217,049 | 6/1993 | Forsyth | 140/57 |

*Primary Examiner*—Lowell A. Larson

*Attorney, Agent, or Firm*—Cushman, Darby & Cushman

[57] ABSTRACT

The controlling apparatus includes a wire supplying sensor 18 for detecting a number of rotations of a wire supplying motor 8, a wire twisting sensor 49 for detecting actuation of a loaded torque detecting mechanism c, and a return position detecting sensor 38 for detecting that a wire twisting mechanism b is located at a predetermined waiting position. In response to an output signal from the wire supplying sensor 18, the controlling apparatus stops rotation of a wire supplying motor *7a* and rotationally drives a wire twisting motor *7b*. In addition, in response to an output signal from the wire twisting sensor 49, the controlling apparatus shifts rotation of the wire twisting motor *7b* in the normal direction to rotation of the same in the reverse direction. Additionally, in response to an output signal from the return position detecting sensor 38, the controlling apparatus stops rotation of the twist driving motor *7b*.

When a start switch 5 is actuated with an operator's hand the controlling apparatus makes it possible to sequentially perform supplying of a predetermined length of binding wire 2, rotating of a twisting shaft 25 until a predetermined torque value is reached, and returning of the wire twisting mechanism b to the initial position.

9 Claims, 12 Drawing Sheets

WIRE BINDER

BACKGROUND OF THE INVENTION

The present invention relates to a wire binder wherein a binding wire is supplied around a plurality of articles such as reinforcement steel rods or the like to be bound so as to allow the binding wire to be circularly wound around the articles, a part of the circularly wound binding wire is seized and twisted so as to allow the circularly wound wire to be tightened, and thereafter, the binding wire is released from the seized state.

A wire binder as disclosed in a Japanese Examined Patent Publication No. 59-39027 has been hitherto known as a typical conventional wire binder of the aforementioned type. This wire binder is constructed such that a binding wire wound around a bobbin is unreeled from the latter so as to allow it to be wound around a plurality of articles such as reinforcement steel rods or the like to be bound especially at their intersections, and thereafter, a part of the circularly wound wire is seized and twisted to tightly bind the articles together. Wire supplying, wire cutting and wire twisting and other operations are sequentially performed by actuating a single start lever.

With the conventional wire binder constructed in the above-described manner, as a trigger switch is actuated with an operator's hand, a driving motor is activated, causing a cam to be rotationally driven. While the cam is rotated by one revolution, various mechanism in the wire binder are sequentially actuated. In other words, a predetermined length of binding wire is supplied around a plurality of articles to be bound via an arc-shaped guide, and thereafter, a twisting shaft is rotated by a predetermined number of revolutions to tightly bind the articles with the binding wire.

However, since the twisting shaft is always rotated by a given number of revolutions, in case that the binding wire has a small diameter, there arises a malfunction that the articles fail to be bound together with the binding wire due to the weakly tightened state. To cope with employment of a binding wire having a larger diameter, the wire binder is modified such that it additionally includes a mechanism which serves to induce slippage between a twisting shaft and a driving shaft after a predetermined magnitude of twisting torque is reached with the aid of a clutch or the like in a twist/rotate driving system. However, with this modified wire binder, a time which elapses during the occurrence of slippage is useless for each binding operation. In addition, there arises a problem that clutching sound is intermittently generated during the slippage, resulting in a working environment of the wire binder being deteriorated.

Particularly, since the foregoing type of wire binder is usually operated using a battery, when the twisting shaft is rotated with slippage, there arises another malfunction that the number of binding operations per one battery charge is reduced.

The Japanese Examined Patent Publication No. 59-39027 also shows a conventional wire binder having a typical conventional torque detecting mechanism including a clutch mechanism wherein raised portions are brought in engagement with the corresponding recessed portions by the resilient force of a spring spanned between an output shaft and a twist shaft in a speed reduction mechanism operatively connected to a motor shaft. Specifically, the conventional torque detecting mechanism is constructed such that when the loaded torque arising during the twisting operation reaches a predetermined value, the raised portions and the recessed portions are parted away from each other against the resilient force of the spring, causing slippage to occur between the output shaft and the twisting drive shaft, resulting in any torque in excess of a predetermined magnitude of torque failing to be exerted on the twisting drive shaft.

With the conventional torque detecting mechanism constructed in the above-described manner, however, due to the fact that the clutch mechanism is disposed between the output shaft having a reduced speed and the twisting drive shaft, a large magnitude of torque is usually exerted on the clutch mechanism. Thus, there arises a necessity that the spring for bringing the raised portions in engagement with the recessed portions has a high intensity of resilient force. This leads to a problem that an assembling operation and an adjusting operation are unavoidably performed in a complicated manner.

In addition, it is necessary that a movable clutch member is arranged in the axial direction between the output shaft and the twisting drive shaft, and moreover, a spring for squeezing the clutch member and a mechanism for adjusting an intensity of resilient force of the spring are additionally arranged in operative association with the movable clutch member. Thus, there arises another problem that the foregoing mechanism is enlarged not only in size bust also in weight.

With respect to a tool adapted to operate with the aid of a rechargeable battery, since a motor having a large quantity of electricity consumption is rotated further after a predetermined magnitude of torque is reached with the tool, there arises a problem that the number of binding operations to be achieved per one electric charge is reduced, resulting in an operational efficiency being degraded.

The Japanese Patent Examined Publication No. 59-39027 further shows a wire binder for binding a plurality of articles to be bound using a binding wire wherein an arc-shaped guide portion is arranged on the front side relative to a wire supplying mechanism for successively supplying a long binding wire in the forward direction, the binding wire discharged from the foremost end of an arc-shaped guide portion is wound around a plurality of articles to be bound by several turns, and the articles are bound together by seizing and twisting a part of the X wound binding wire has been hitherto known as a typical binder of the foregoing type. With the conventional binder constructed in the above-described manner, since it is necessary that the binding wire is cut prior to the twisting after it is wound around the articles to be bound, a cutting mechanism is disposed at the fore end part of the arc-shaped guide portion. To actuate the cutting mechanism, a wire rope is extensively arranged along the arc-shaped contour of the guide portion wherein one end of the wire rope is connected to the cutting mechanism, while the other end Of the same is connected to an actuating mechanism in the binder.

However, with the system for cutting a binding wire by pulling a wire rope in the above-described manner, since the wire rope is elongated during each pulling operation, there arise malfunctions that the binding wire can not reliably be cut by the cutting mechanism, and moreover, reliability on the actuation of the cutting mechanism is degraded. In addition, there arises a necessity for arranging an adjusting mechanism to cope with the elongation of the wire rope. In practice, however, the adjusting mechanism should be readjusted frequently.

Since the wire rope is arranged along the arc-shaped contour of the guide portion, the cutting mechanism receives a large magnitude of resistance during each cutting operation. This leads to a problem that the wire rope is cut due to friction appearing between the wire rope and the guide portion, causing the cutting mechanism to be incorrectly actuated.

If the cutting mechanism is arranged in the linear region before the arc-shaped part of the guide portion, the cutting mechanism can be actuated using a rod without any appearance of the aforementioned problem. However, since a part of the cut binding wire remains still in the arc-shaped part of the guide portion, interference occurs between the guide portion and the bound part of the binding wire after the latter is twisted, resulting in workability of the binder being degraded.

A Japanese Patent Examined Publication No. Hei. 3-60989 teaches a conventional wire binder having an apparatus for controlling a twisting hook employable for a binder for binding a binding wire. According to the conventional wire binder, the apparatus is constructed such that a chucking member adapted to slidably move in the axial direction is arranged around the outer peripheral surface of a twist shaft having a hook for seizing a binding wire pivotally supported thereon so that the hook is opened or closed by slidable movement of the chucking member relative to the twist shaft. In addition, a cam mechanism is employed for the apparatus for slidably displacing the chucking member. This leads to a necessity for arranging a power transmission shifting mechanism which serves to rotationally drive the twist shaft as desired.

The conventional wire binder is required to locate the hook to assume a predetermined angle after completion of a series of binding steps. According to the conventional wire binder, a mechanism for opening the hook by rotating the twisting shaft in the reverse direction after completion of each binding operation, and at the same time, stopping the hook at a predetermined position by bringing the hook in engagement with an abutment member to stop the reverse rotation of the twist shaft by rotating the abutment member is used for the binder. However, with the mechanism as mentioned above, since the abutment member is arranged in the vicinity of a plurality of articles to be bound, there is a possibility that the abutment member is damaged or injured when it comes in engagement with the articles during each binding operation.

SUMMARY OF THE INVENTION

The present invention has been made in consideration of the foregoing background.

It is an object of the present invention to provide a wire binder having an apparatus for controlling one cycle of binding operation to be performed by the wire binder wherein the apparatus makes it possible to sequentially perform supplying of a predetermined length of binding wire, rotating of a twisting shaft until a predetermined torque value is reached, and returning of a twisting mechanism to an initial position merely by actuating a start switch.

It is an another object of the present invention is to provide a wire binder having an apparatus for controlling one cycle of binding operation to be performed by the wire binder wherein the apparatus assures that the twisting shaft can be rotated, regardless of a diameter of the binding wire to be wound around a plurality of articles to be bound, without any useless driving of motors until a predetermined magnitude of loaded torque is reached.

To accomplish the above objects, a first aspect of the present invention provides a wire binder having an apparatus for controlling one cycle of binding operation to be performed by the wire binder including a wire supplying mechanism for continuously supplying a binding wire to an arc-shaped guide portion which serves to guide the movement of the binding wire with the aid of a wire supplying roller adapted to be rotationally driven by a wire supplying motor so as to allow the binding wire to be circularly wound about a plurality of articles to be bound, a wire twisting mechanism for seizing and twisting a part of the binding wire with a hook displaced to the position where the binding wire is circularly wound around the articles when the wire supplying roller is rotated in the normal direction, and moreover, for displacing the hook away from the foregoing position to a waiting position to release the binding wire from the seized state when the wire supplying roller is rotationally driven in the reverse direction, a loaded torque detecting mechanism disposed between a twist driving motor and a wire twisting mechanism, the loaded torque detecting mechanism being actuated on receipt of a predetermined magnitude of loaded torque when the binding wire is twisted by the wire twisting mechanism, and a start switch adapted to be manually actuated to activate the wire supplying motor, wherein the apparatus is characterized in that the apparatus includes a wire supplying sensor for detecting a predetermined number of rotations of the wire supplying roller, a wire twisting sensor for detecting actuation of the loaded torque detecting mechanism, and a return position detecting sensor for detecting that the wire twisting mechanism is located at a predetermined waiting position, wherein in response to an output signal from the wire supplying sensor, the apparatus stops rotation of the wire supplying motor and rotationally drives the twist driving motor in the normal direction, in response to an output signal from the wire twisting sensor, the apparatus shifts rotation of the wire twist driving motor in the normal direction to rotation of the same in the reverse direction, and in response to an output signal from the return position detecting sensor, the apparatus stops rotation of the twist driving motor in the reverse direction.

With the apparatus for controlling one cycle of binding operation to be performed by a wire binder (hereinafter referred to simply as a controlling apparatus), when the start switch is turned on, the wire supplying motor is rotated to actuate the wire supplying mechanism, causing the binding wire to be unreeled from a bobbin mechanism, whereby the binding wire is continuously supplied to the arc-shaped guide portion so as to allow it to be wound around the articles to be bound together. In response to an output signal from the wire supplying sensor after a predetermined length of binding wire is supplied, the controlling apparatus stops rotation of the wire supplying motor and actuates the wire twisting mechanism. Thus, the twist driving motor is rotated in the normal direction so that the hook is displaced to the position where the binding wire is circularly wound, causing a part of the binding wire to be seized and twisted, resulting in the circularly wound wire being tightened. When a predetermined torque value is reached during the twisting operation, the loaded torque detecting mechanism is actuated. This is detected by the wire twisting sensor which in turn outputs a detection signal. In response to the output signal from the wire twisting sensor, the controlling apparatus shifts rotation of the twist driving motor in the normal direction to rotation of the same in the reverse direction, whereby the wire twisting mechanism is activated in the return direction until the hook returns to a predetermined waiting position. In addition, in response to an output signal from the return position detecting sensor which detects that the wire twisting mechanism is located at the waiting position, the controlling apparatus stops rotation of the wire twisting motor in the reverse direction. In this manner, the wire binder completes one cycle of binding operation.

It is a further object of the present invention to provide a wire binder having a mechanism for detecting twist torque appearing on a binding wire wherein the mechanism is arranged between an output shaft of a speed reduction mechanism and a driving motor so that a value of torque for twisting the binding wire can easily be set, and moreover, the mechanism can be actuated without any occurrence of slippage between an output shaft of the motor and the twisting drive shaft while saving excessive electricity consumption by allowing rotation of the motor to be stopped after a predetermined magnitude of torque is detected.

To accomplish the above object, a second aspect of the present invention provides a mechanism for detecting twist torque appearing on a binding wire in operative association with a speed reduction mechanism including as essential components a sun gear fixedly mounted on an output shaft of a driving motor, a plurality of planet gears each meshing with said sun gear and an internal gear arranged around said planet gears so as to allow the number of rotations of the output shaft of the driving motor to be reduced in order to twist the binding wire at the reduced rotational speed, wherein the mechanism is characterized in that the internal gear is arranged to be rotatable in a housing within the range defined by a predetermined angle, that the internal gear is normally biased by a spring which can adjustably be actuated from the outside in such a direction that torque is exerted on the internal gear when the latter is driven in a predetermined direction, that a twist sensor is arranged between the outer peripheral surface of the internal gear and the housing so as to detect that the internal gear has been rotated against the biasing force of the spring, and a control unit is arranged for the purpose of stopping rotation of the driving motor in response to a signal output from the twist sensor.

With the twist torque detecting mechanism constructed in the above-described manner, as long as the twist torque exerted on a twisting drive shaft of a twisting mechanism does not reach a predetermined value, the internal gear is not rotated or it is rotated within the narrow range defined by a small quantity of rotation, resulting in the twist sensor failing to operate. On the contrary, when the twist torque having a magnitude in excess of a predetermined value is exerted on the twisting drive shaft, the sun gear is rotated by the rotational force of the drive motor and the planet gears are then rotated by the sun gear. While a predetermined magnitude of twist torque is normally exerted on the twisting drive shaft, a part of the rotational force of the planet gears is transmitted to the internal gear, causing the internal gear to be rotated against the resilient force of the spring. When a quantity of rotation of the internal gear increases as the latter is rotated, the twist sensor detects that the internal gear has been rotated, causing a detection signal to be output therefrom. In response to the detection signal, the control unit is activated to stop rotation of the drive motor.

When the present value of twist torque is to be adjusted, the extent of deflection of the spring serving from the outside to resist against rotation of the internal gear is properly adjusted so as to allow the resilient force of the spring to match with a desired torque value.

It is a further another object of the present invention to provide a wire binder having an apparatus for guiding movement of a binding wire wherein a cutting mechanism is disposed at the linear part of a guide portion so as to enable the cutting mechanism to be actuated using a rod, and moreover, the end part of the binding wire can easily be removed away from an arc-shaped part of the guide portion after completion of each cutting operation.

To accomplish the above object, a third aspect of the present invention provides a wire binder an apparatus for guiding movement of a binding wire wherein the binder is constructed such that a linear guide portion is disposed on the front side relative to a wire supplying mechanism for successively supplying the binding wire in the forward direction, a guide portion of which fore end is bent in the arc-shaped contour is disposed downstream of the linear guide portion, the binding wire discharged from the fore end of the arc-shaped guide portion is wound around a plurality of articles to be bound by several turns, and the articles are bound together by seizing and twisting a part of the X wound binding wire, wherein the apparatus is characterized in that a cutting mechanism for cutting the binding wire is disposed at a predetermined position between the linear guide portion and the arc-shaped guide portion, the arc-shaped guide portion is constructed of a side plate portion of which fore part is bent in the arc-shaped contour and a movable member having an arc-shaped groove recessed on a surface located opposite to one side surface of the side plate portion, the movable member is displaceable away from the side plate portion and normally biased toward the side plate portion by the resilient force of a spring, and an inclined surface adapted to be engaged with the binding wire in the arc-shaped groove is formed at the fore end part of the movable member in such a manner as to allow the movable member to be parted away from the side plate portion.

With the apparatus constructed in the above-described manner, a binding wire supplied from the wire supplying mechanism to the arc-shaped guide via the linear guide portion moves along the arc-shaped groove. However, since the movement of the winding wire is guided with the aid of the arc-shaped groove while the binding wire exhibits the arc-shaped contour, the winding wire is discharged from the guide portion while maintaining the arc-shaped contour, and thereafter, the foremost end of the winding wire is introduced into the guide groove with the aid of a guiding piece, whereby the winding wire is wound along the arc-shaped groove. Thus, when a plurality of articles such as rods or the like to be bound are arranged inside of the guide portion, the winding wire is X wound around the articles. Subsequently, when the binder is forcibly taken away from the articles, the binding wire in the arc-shaped groove is brought in engagement with the inclined surface at the fore end part of the movable member, causing the latter to be parted away from the side plate portion as if it is forcibly opened against the resilient force of the spring. Thus, the arc-shaped groove is exposed to the outside so that the binding wire in the arc-shaped groove is removed from the latter.

It is an still further object of the present invention to provide a wire binder having an apparatus for controlling a twisting hook employable for a binder wherein the apparatus makes it possible to open or close the hook, rotationally drive the hook at a predetermined position and stop the rotation of the hook at the foregoing predetermined position.

To accomplish the above object, a fourth aspect of the present invention provides a wire binder an apparatus for controlling a twisting hook wherein the binder is constructed such that a binding wire is continuously supplied to an arc-shaped guide portion disposed in front of a wire supplying mechanism, the binding wire discharged from the foremost end of the arc-shaped guide portion is wound around a plurality of articles to be bound by several turns, and a part of the X wound binding wire is seized and twisted by a hook adapted to be driven by a twisting drive motor so as to enable the articles to be wound with the binding wire, wherein the apparatus is characterized in;

that a twisting drive shaft operatively connected to the twisting drive motor via a speed reduction mechanism is jointed to a twisting shaft disposed forward of the twisting drive shaft so as to allow both the shafts to be rotated about a common axis separately from each other, a spirally extending groove is formed on the outer peripheral surface of the twisting drive shaft, the base end part of the hook is openably supported on the twisting shaft, and a sleeve is arranged across the outer peripheral surfaces of the twisting drive shaft and the twisting shaft in such a manner as to rotate relative to the twisting shaft, and moreover, slidably move in the axial direction relative to the twisting shaft, that a ball receiving portion of which part is fitted onto the spirally extending groove of the twisting drive shaft is formed on the inner surface of the sleeve, and a pin loosely received in an elongated hole formed at the central part of the hook is disposed on the fore end side of the sleeve, that a plurality of projections are formed on the outer peripheral surface of the sleeve in the circumferential direction, and a normal rotation stopper for preventing the sleeve from being rotated in the normal direction when the projections are engaged with the normal rotation stopper and a reverse rotation stopper for preventing the sleeve from being rotated in the reverse direction when the projections are engaged with the reverse rotation stopper are arranged in the vicinity of the outer peripheral surface of the sleeve, that when the twisting drive shaft is rotated in the normal direction, the projections are engaged with the normal rotation stopper so that rotation of the sleeve located at the initial position in the normal direction is prevented, the sleeve slidably moves along the spirally extending groove of the twisting drive shaft together with a plurality of balls in the forward direction to turn the sleeve in the direction of closing of the hook, and when the sleeve reaches the end position of slidable movement thereof, the projections are released from the engaged state relative to the normal rotation stopper so as to allow the sleeve and the twisting drive shaft to be rotated together in the normal direction, and that when the twisting drive shaft is rotated in the reverse direction, the projections are engaged with the reverse rotation stopper so as to allow the sleeve to slidably move to the initial position.

With the apparatus constructed in the above-described manner, when the twisting drive motor is activated to rotate in the normal direction, the projections on the sleeve are engaged with the normal rotation stopper so that rotation of the sleeve located at the initial position is prevented, and then, the sleeve slidably moves with the aid of the balls rolling in the spirally extending groove on the twisting drive shaft. Since the pin is also displaced as the sleeve slidably moves in that way, the hook pivotally supported on the twisting shaft is rotated in the direction of closing thereof, whereby a part of the binding wire X wound around a plurality of articles to be bound is seized by the hook. When the balls in the spirally extending groove reaches the end position of the latter, the sleeve reaches the end position of slidable movement thereof. Thus, while the sleeve is held at the last-mentioned end position, the engaged relationship between the normal rotation stopper and the projections is canceled, causing the sleeve to be rotated together with the drive shaft, whereby the binding wire is twisted.

Next, when the drive motor is rotated in the reverse direction, not only the twisting drive shaft and the twisting shaft but also the sleeve are rotationally driven in the reverse direction. At this time, the projections on the sleeve are engaged with the reverse rotation stopper while preventing the sleeve from being rotated in the reverse direction. Subsequently, the sleeve slidably moves in the return direction with the aid of the balls in the spirally extending groove until it is restored to the initial position. Since the pin is displaced in the same direction, the hook is opened, resulting in the binding wire being released from the seized state.

It is an still furthermore object of the present invention to provide a wire binder having a bobbin mechanism for a wire binder which assures that a part of a winding wire does not remain in the region extending between a cutter mechanism and an outlet port of an arc-shaped guide under a condition that an operator visually recognizes with a bobbin cover automatically opened that a binding operation is completed while a part of the binding wire having a length corresponding to at least one binding operation remains on a wire bobbin.

To accomplish the above object, a fifth aspect of the present invention provides a wire binder having a bobbin mechanism which includes as essential components a pair of brackets projecting from a housing of the wire binder, a support shaft rotatably supported to be rotated relative to the one bracket, the support shaft being slidably displaceable in the axial direction, a wire bobbin rotatably supported on the support shaft inside of the brackets, a bobbin cover of which one side wall is turnably supported to turn about the support shaft together with the latter in the closing direction and of which other side wall is turnably supported by the other bracket to turn in the opening direction by the resilient force of a coil spring, and a bobbin cover lock adapted to be engaged with and disengaged from the support shaft, the bobbin cover serving to hold the bobbin cover at the closed position when it is engaged with the engagement portion, that the wire bobbin is divided into two bobbin halves ar a right angle relative to the axial direction, the bobbin halves are connected to each other in such a manner as to axially move to come near to each other and part away from each other, the bobbin halves are normally biased by the resilient force of another coil spring in such a direction that they come near to each other, the bobbin halves are held in the parted state when a binding wire is closely wound around the wire bobbin, and the bobbin halves are displaced to come near to each other by the resilient force of the coil spring when a part of the binding wire having a length corresponding to a final binding operation is unreeled from the wire bobbin, resulting g in the parted state of the bobbin halves being canceled, and that the support shaft is displaced in the axial direction as the bobbin halves come near to each other and move away from each other, the engagement portion is engaged with the bobbin cover lock when the bobbin halves are held in the parted state, and the engagement portion is disengaged from the bobbin cover lock when the bobbin halves come near to each other, causing the bobbin cover to be turned in the opening direction.

With the bobbin mechanism constructed in the above-described manner, as a binding operation is repeatedly performed, the binding wire wound around the wire bobbin is unreeled therefrom and increasingly consumed. When a part of the binding wire having a length corresponding to a final binding operation is consumed, the parted state of the bobbin halves given by the binding wire wound around the wire bobbin is canceled, whereby the bobbin halves are displaced to come near to each other by the resilient force of the coil spring. Consequently, the engagement portion projecting from the support shaft is disengaged from the bobbin cover lock, enabling the support shaft to be rotated, resulting in the bobbin cover being turned in the opening direction.

Since an operator can visually recognize that the binding wire is completely consumed at this time, he stops his work. This makes it possible to reliably prevent a part of the binding wire from remaining in the region extending between a cutter mechanism and an outlet port of an arc-shaped guide.

DETAILED DESCRIPTION OF THE PREFERRED EMBODIMENTS

Figure 1:
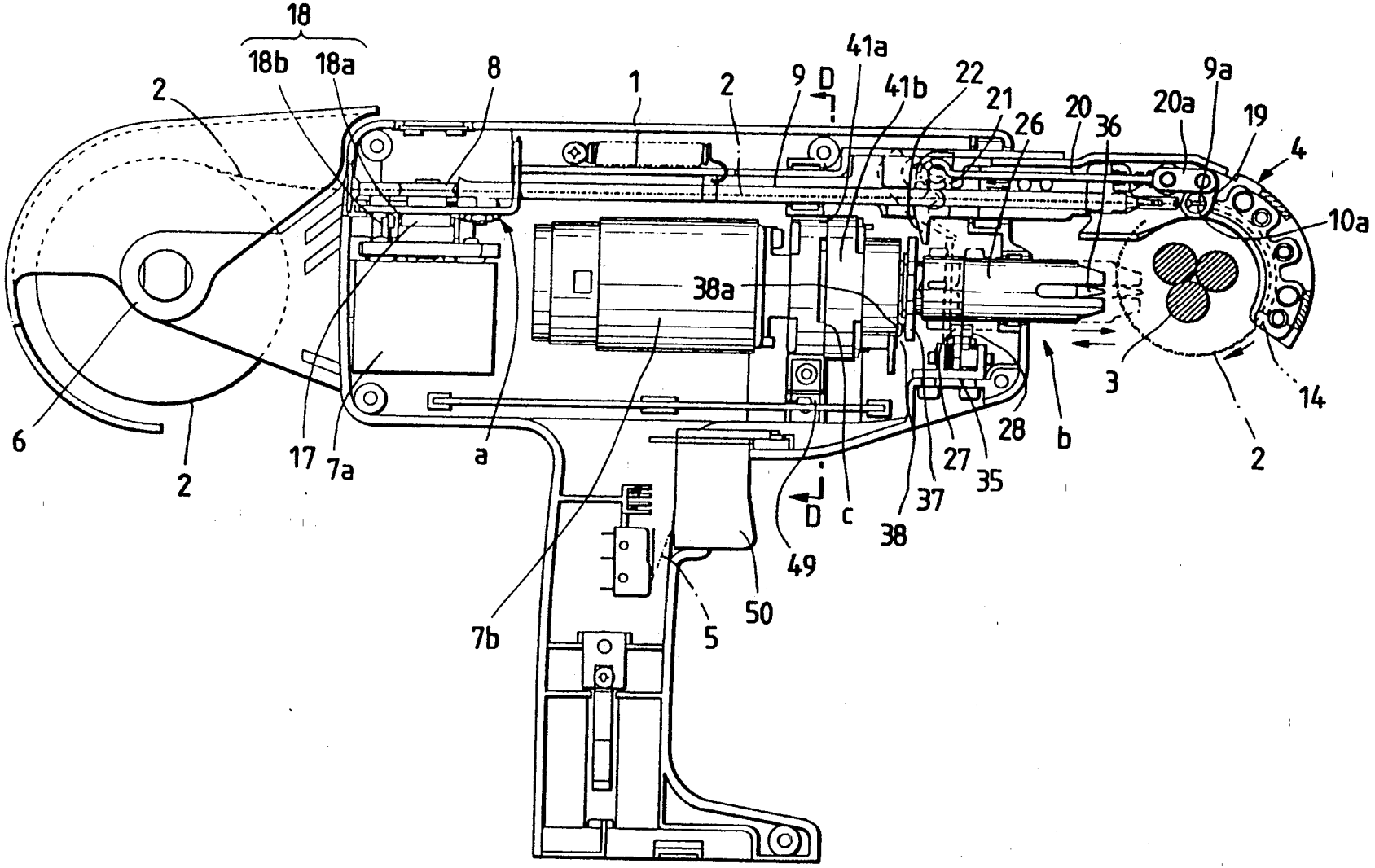
FIG. 1 is a vertical sectional view of a wire binder taken along a central plane.
Figure 2:
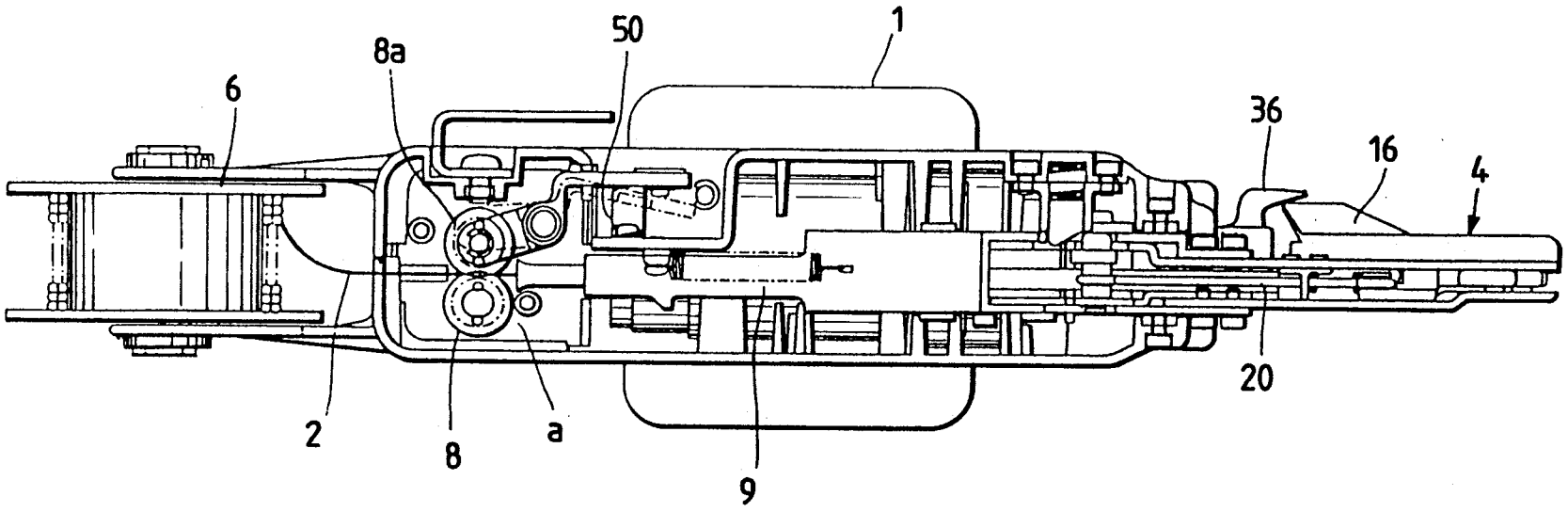
FIG. 2 is a plan view of the wire binder shown in FIG. 1.

FIG. 1 and FIG. 2 show a wire binder of an embodiment of the present invention. The wire binder includes as essential components a wire supplying mechanism a for continuously supplying a binding wire 2 to an arc-shaped guide 4 portion adapted to guide the movement of the binding wire 2 so as to allow the binding wire 2 to be wound around a plurality of articles 3 to be bound, a wire twisting mechanism b for twisting a part of the winding wire 2, i.e., the foremost end part of the same circularly wound around the articles 3, a loaded torque detecting mechanism c adapted to be actuated with a predetermined magnitude of torque loaded on the wire twisting mechanism b, and a start switch 5 adapted to be manually actuated in a housing 1. In addition, the wire binder includes a controlling apparatus for controlling a driving power source (motor) in response to a detection signal output from a sensor disposed at each of the aforementioned mechanisms.

Description will be made below with respect to each of the mechanisms and the controlling apparatus. First, a bobbin mechanism 6 having a long binding wire 2 wound therearound is disposed at the rear end of the housing 1. The wire supplying mechanism a serves to supply the binding wire 2 wound around the bobbin mechanism 6 toward the foremost end side of the housing 1 by rotating a wire supplying roller 8 as a wire supplying motor 7*a* is rotationally driven. The wire supplying motor 7*a* is arranged at the rear part of the housing 1, and a wire supplying roller 8 is operatively connected to an output shaft of the wire supplying motor 7*a* via wire supplying gears. A movable wire supplying roller 8*a* is disposed at the position located opposite to the wire supplying roller 8. The movable wire supplying roller 8*a* is brought in meshing contact with the wire supplying roller 8 to supply the binding wire 2 while holding the same in the clamped state by the resilient force of a spring 50. A linear guide portion 9 is formed along the upper part of the housing 1 on the downstream side of the wire supplying roller 8 for the purpose of linearly guiding the movement of the binding wire 2 supplied from the wire supplying roller 8. In addition, an arc-shaped guide portion 4 is arranged downstream of the linear guide portion 9.

Figure 5:
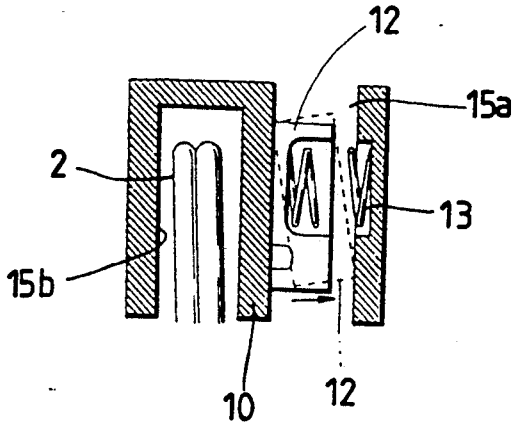
FIG. 5 is a fragmentary cross-sectional view of the arc-shaped guide portion taken along line B—B in FIG. 3.
Figure 6:
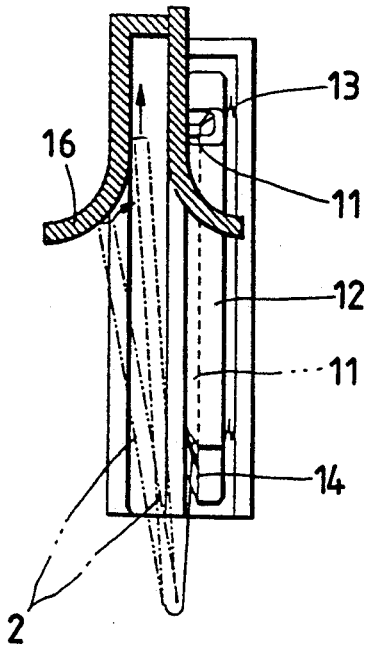
FIG. 6 is a fragmentary cross-sectional view of the arc-shaped guide portion taken along line C—C in FIG. 3.
Figure 7:
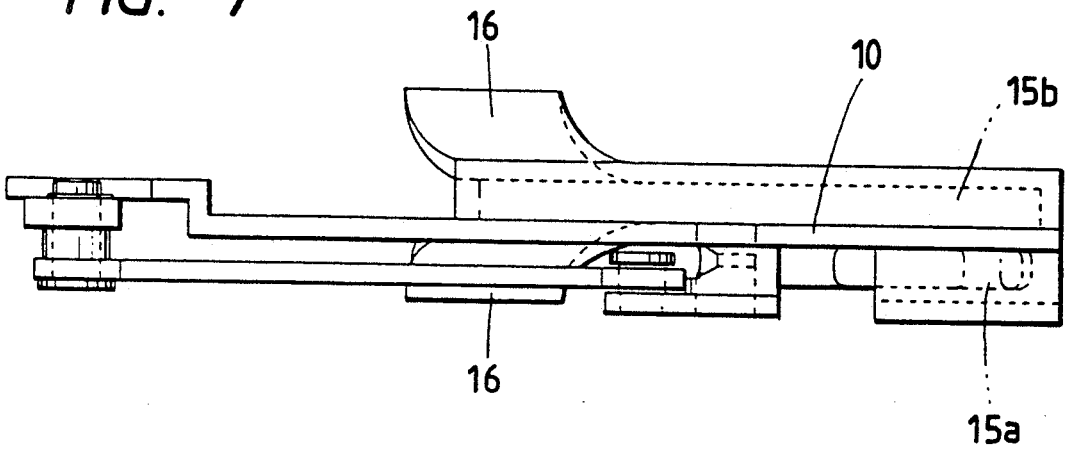
FIG. 7 is an illustrative view which shows that a binding wire is discharged from the arc-shaped guide portion.
Figure 8:
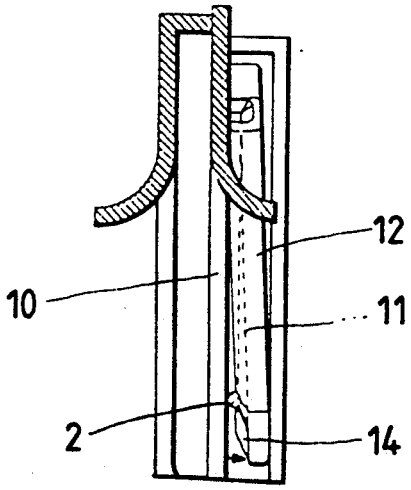
FIG. 8 is an enlarged plan view of the arc-shaped guide portion.

As shown in FIG. 3 to FIG. 8, the arc-shaped guide portion 4 includes a side plate portion 10 of which fore part is bent in the arc-shaped contour, of which one side serves as a receiving recess 15*a* and of which other side serves as a guiding recess 15*b*. In addition, the arc-shaped guide portion 4 includes a movable member 12 which is movably received in the receiving recess 15*a*. The movable member 12 is formed with an arc-shaped recessed groove 11 on the side wall surface located opposite to one side wall of the side plate portion 10 such that it moves toward and away from the side plate portion 10. As is best seen in FIG. 5, the movable member 12 is normally biased by the resilient force of a coil spring 13 to come in close contact with the side plate portion 10. An inclined surface 14 is formed along the foremost end part of the movable member 12 in such a manner as to be engaged with the binding wire 2 in the arc-shaped recessed groove 11 while moving away from the side plate portion 10. In addition, guide pieces 16 each expanding in the downward direction are formed on the opposite sides of the guide recess 15*b* while extending along the lower end of the guide recess 15*b*.

A wire supplying sensor 18 for detecting a predetermined number of rotations of the wire supplying roller 8 is disposed between a speed reduction gear 17 of the wire supplying motor 7*a* and the housing 1. Specifically, the wire supplying sensor 18 consists of a magnet 18 fixedly secured to the outer surface of an output shaft of the wire supplying motor 7*a* and a hole element 18*b* disposed on the housing side 1.

It should be added that a cutting mechanism d is arranged between the linear guide portion 9 of the housing 1 and the arc-shaped guide portion 4. The cutting mechanism d serves to cut the binding wire 2 between the linear guide portion 9 and the arc-shaped recessed groove 11. Specifically, the cutting mechanism d is constructed such that one end of a shearing cutter 19 is turnably supported to turn about a wire guide 10*a* located downstream of the linear guide portion 9, the other end of the shearing cutter 19 is operatively connected via a joint plate 20*a* to one end of a rod 20 extending in alignment with the linear guide portion 9, the other end of the rod 20 is operatively connected to a link plate 21 pivotally supported on the side plate portion 10, and an actuating piece 22 is formed on the link plate 21 so as to actuate the rod 20 and the link plate 21 by driving the actuating piece 22 in order to cut the binding wire 2 between the linear guide portion 9 and the arc-shaped recessed groove 11. The actuating piece 22 is driven by the wire twisting mechanism b to be described later after the binding wire 2 is wound around the articles 3 by a predetermined number of turns. That is, the shearing cutter 20 is rotationally driven by axially displacing the rod 20 in the rearward direction, whereby the binding wire 2 can be cut at the position directly before the arc-shaped guide portion 4 by interrupting the communicated state between a wire insert hole 19*a* and a wire path 9*a* for the wire guide 10*a*. It should be noted that the wire insert hole 19*a* is formed through the shearing cutter 19 in alignment with the wire path 9*a* in the wire guide 10*a*, and the shearing cutter 19 is normally biased by the resilient force of a spring (not shown) to assume a directional attitude for properly guiding the movement of the binding wire 2 through the wire insert hole 19*a*.

With this construction, as the binding wire 2 is supplied to the arc-shaped guide portion 4, it moves along the arc-shaped recessed groove 11, causing the movement of the binding wire 2 to be properly guided while assuming the arc-shaped contour coincident with that of the groove 11. Thus, the binding wire 2 is discharged from the guide portion 4 while exhibiting the arc-shaped contour so that it is wound in the annular configuration. The foremost end of the circularly wound binding wire 2 is introduced into a guide recess portion 15*b* so that the binding wire 2 is circularly wound in the guide recess portion 15*b*. Thus, when a plurality of articles 3 such as steel rods or the like to be bound are placed in the arc-shaped guide portion 4, the winding wire 2 is circularly wound around the articles 3. At this time, the number of rotations of the wire supplying roller 8 is detected by the wire supplying sensor 18, and subsequently, when a length of the winding wire 2 unreeled from the bobbin mechanism 6 and then wound around the articles 3 reaches a predetermined supply quantity (i.e., when the number of rotations of the wire supplying roller 8 reaches a predetermined number), a detection signal is output from the wire supplying sensor 18.

When the articles 3 are forcibly parted away from the wire binder with an operator's hand after a part of the binding wire 2 is cut out by actuating the cutting mechanism d in operative association with the wire twisting mechanism b, the foremost end of the binding wire 2 received in the arc-shaped recessed groove 11 is first brought in contact with the inclined surface 14, causing the movable member 12 to be parted away from the side plate portion 10 against the resilient force of the coil springs 13 as if the movable member 12 is forcibly opened by a wrenching operation performed with an operator's hand. Consequently, the arc-shaped recessed groove 11 is exposed to the outside, enabling the binding wire 2 in the arc-shaped recessed groove 11 to be easily removed from the latter (see FIG. 7).

Figure 9A:
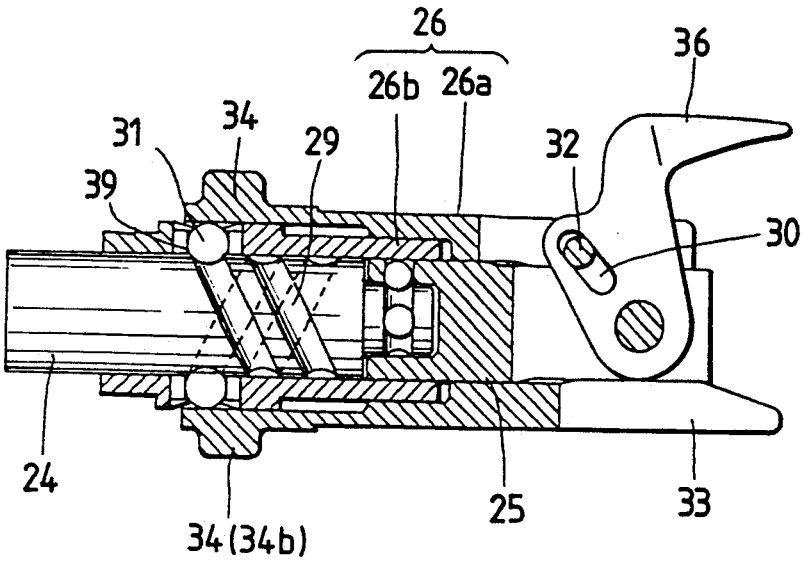
FIG. 9(*a*) is a vertical sectional view of a wire twisting mechanism for the wire binder and FIG. 9(*b*) is a side view of the wire twisting mechanism.
Figure 9B:
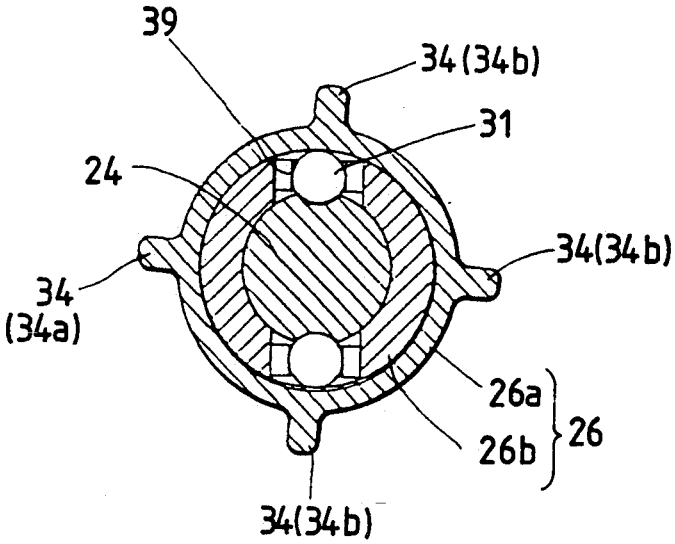

Next, the wire twisting mechanism b is operated such that a hook 36 for seizing the binding wire 2 is displaced to a predetermined seizing position or a predetermined waiting position by activating a twist driving motor 7b, a part of the binding wire 2 circularly wound around the articles 3 is seized and twisted by the hook 36 by rotationally driving the twist driving motor 7b in the normal direction, and the binding wire 2 is then released from the hook 36 by rotationally driving it in the reverse direction. Specifically, the wire twisting mechanism b includes a twist driving shaft 24 operatively connected to the twist driving motor 7b vis speed reduction mechanisms 41a and 41b and a twisting shaft 25 disposed ahead of the twist driving shaft 24 in the concentrical relationship relative to the latter. In addition, a hook 36 is turnably supported on the twisting shaft 25, and a sleeve 26 is fitted onto the twist driving shaft 24 and the twisting shaft 25 (see FIG. 9(*a*) and FIG. 9(*b*)). Additionally, a normal rotation stopper 27 and a reverse rotation stopper 28 are arranged in the vicinity of the outer peripheral surface of the sleeve 26 (see FIG. 10(*b*)).

A spirally extending groove 29 is formed around the outer peripheral surface of the twist driving shaft 24, and the twist driving shaft 24 and the twisting shaft 25 are operatively connected to each other so that they are separately rotated about a common axis. The base end part of the hook 36 is pivotally supported on the twisting shaft 25, and an elongated hole 30 is formed through the hook 36 at the central part of the latter.

The sleeve 26 consists of an outer sleeve 26a and an inner sleeve 26b which are integrated with each other via pins (not shown). In addition, the sleeve 26 is arranged to be rotatable relative to the twist driving shaft 24, and moreover, be slidable relative to the twist driving shaft 24 and the twisting shaft 25.

A ball receiving portion 39 is formed on the inner surface of the sleeve 26 for receiving balls 31 each of which part is fitted into the spirally extending groove 29, and a pin 32 loosely fitted through the elongated hole 30 is disposed at the fore end part of the sleeve 36. To allow the hook 36 to be turnably displaced, cutouts 33 are formed through the upper and lower opposing walls of the sleeve 26. In addition, a plurality of projections 34 are formed on the outer peripheral surface of the sleeve 36 in the spaced relationship as seen in the circumferential direction. The projections 34 are divided into a projection 34a having a long length and projections 34b each having a short length as seen in the longitudinal direction.

The normal rotation stopper 27 serves to prevent the sleeve 26 from being rotated in the normal direction, while the reverse rotation stopper 28 serves to prevent it from being rotated in the reverse direction. Both the stoppers 27 and 28 are arranged on a support anvil 35 located in the vicinity of the outer peripheral surface of the sleeve 26 while extending in parallel with the axial direction of the sleeve 36. Each of the stoppers 27 and 28 is turnably supported to turn only in one direction while it is normally biased in the reverse direction by the resilient force of a spring 23.

When the twist driving shaft 24 is rotated in the normal direction, one of the projections 34 is engaged with the normal rotation stopper 27 so as to prevent the sleeve 26 located at the initial position from being rotated in the normal direction, and moreover, slidably displace the sleeve 26 in the forward direction together with the balls 31 received in the spirally extending groove 29, causing the hook 36 to be turned in the closing direction. When the sleeve 26 reaches the end position for slidable displacement thereof, the normal rotation stopper 27 is disengaged from the projection 34 so that the sleeve 26 and the twist driving shaft 24 are rotated together in the normal direction. On the other hand, when the twist driving shaft 24 is rotated in the reverse direction, one of the projections 34 is engaged with the reverse rotation stopper 28 so as to allow the sleeve 26 to be slidably displaced until it reaches the initial position thereof.

A projection plate 37 projecting from the sleeve 26 in the radial direction is fixedly secured to the sleeve 26 at the base end of the latter, and a magnet 38a is attached to the rear surface of the projection plate 37. On the other hand, a hole element 38b is disposed on the front surface of a cover 40 for the speed reduction mechanism, whereby a return position detecting sensor 38 is constructed of the magnet 38a and the hole element 38b for detecting that the twisting mechanism b is located at a predetermined return position. The projection plate 37 is formed such that it can be engaged with the actuating piece 22 on the rod 20 both of which constitutes the cutting mechanism d.

Figure 3:
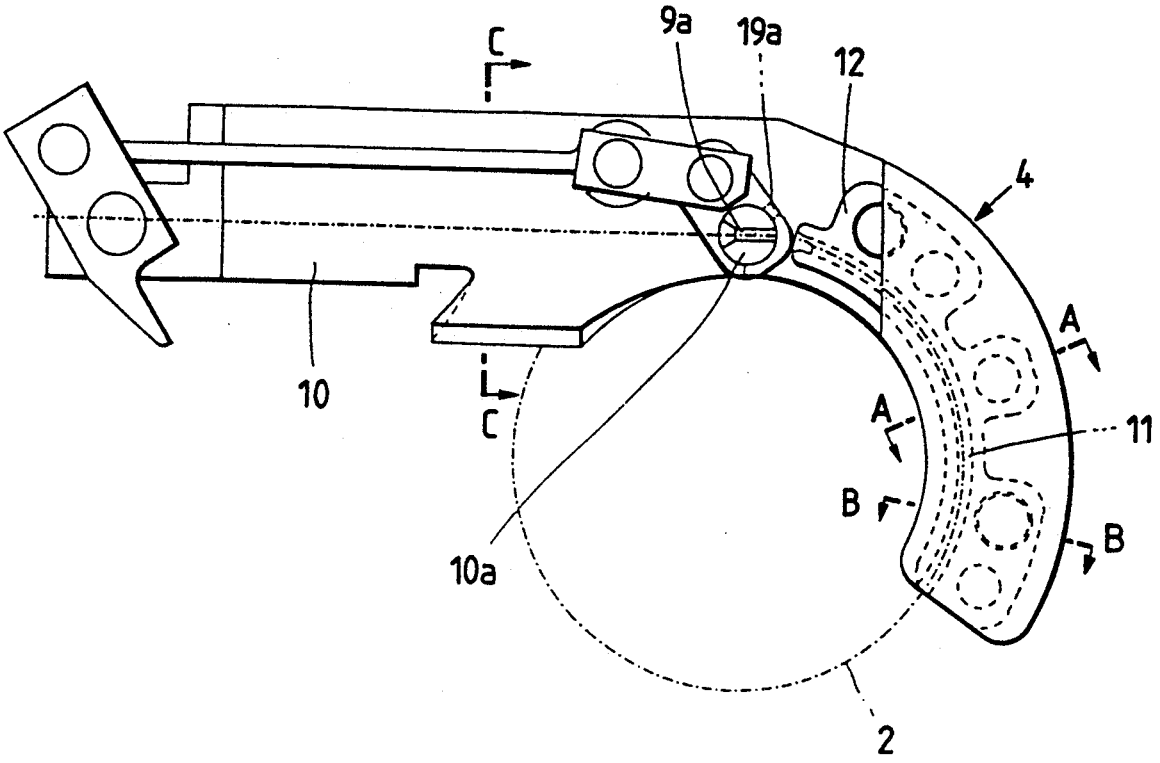
FIG. 3 is a fragmentary enlarged side view of an arc-shaped guide portion for the wire binder.
Figure 4:
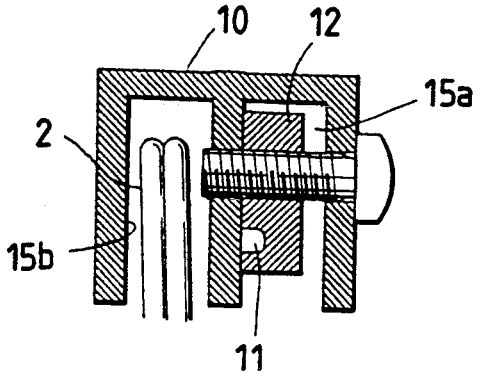
FIG. 4 is a fragmentary cross-sectional view of the arc-shaped guide portion taken along line A—A in FIG. 3.
Figure 10A:
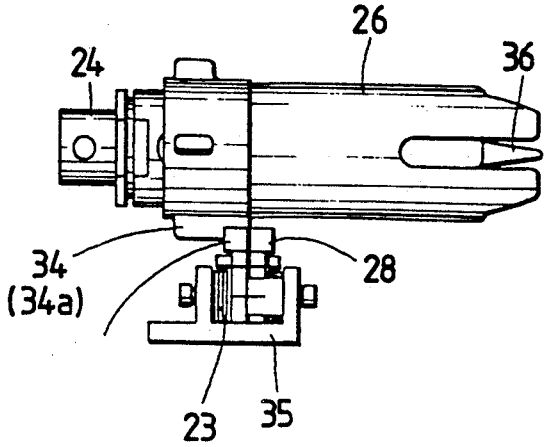
FIG. 10(*a*) is a side view of the wire twisting mechanism prior to start of its operation and FIG. 10(*b*) is a front view of the wire twisting mechanism.
Figure 10B:
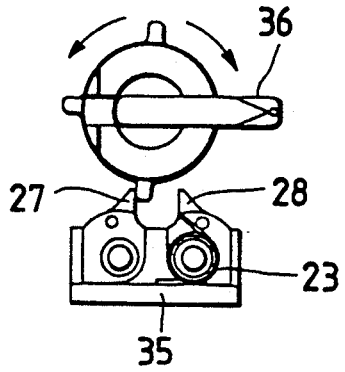

With the wire twisting mechanism b constructed in the above-described manner, when the twist driving motor 7b is activated in the normal direction after the binding wire 2 is unreeled from the bobbin mechanism 6 by a predetermined length by actuating the wire supplying mechanism a and circularly wound around the articles 3, the twist driving shaft 24 is rotationally driven in the normal direction. Thus, the rotational force generated by the twist driving motor 7b is transmitted to the sleeve 26 via the balls 31 loosely fitted into the spirally extending groove 29 on the outer peripheral surface of the twist driving shaft 24 and the ball receiving portion 39 on the sleeve 26. However, since further rotation of the sleeve 26 is prevented due to the engagement of the one projection 34 on the sleeve 26 with the normal rotation stopper 27 on completion of the power transmission, the sleeve 26 is caused to slidably move in the axial direction with the aid of the balls 31 received in the spirally extending groove 29, as shown in FIG. 10(*a*) and FIG. 10(*b*). As the sleeve 26 slidably moves in that way, the pin 32 held on the sleeve 26 is displaced together with the sleeve 26, causing the hook 36 pivotally supported on the twisting shaft 25 to be rotated in the closing direction, whereby a part of the circularly wound wire 2 is seized by the fore end part of the hook 36. Since the projection plate 37 is displaced as the sleeve 26 slidably moves in that way, the actuating piece 22 of the rod 20 constituting the cutting mechanism d is squeezed by the projection plate 37 in the course of the slidable movement of the sleeve 26. This causes the cutting mechanism d to be actuated, whereby the shearing cutter 19 is rotationally driven as shown in FIG. 3. Thus, the binding wire 2 is cut out at the position located upstream of the arc-shaped guide portion 4 while the communication of the wire insert hole 19a with the wire path 9a of the wire guide 10a is interrupted.

Figure 11A:
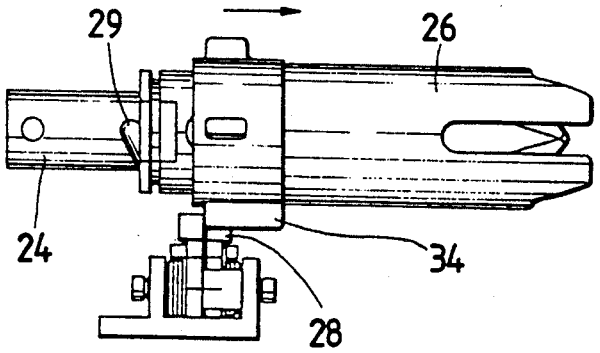
FIG. 11(*a*) is a side view of the wire twisting mechanism during rotation of a twist driving shaft in the normal direction and FIG. 11(*b*) is a front view of the wire twisting mechanism.
Figure 11B:
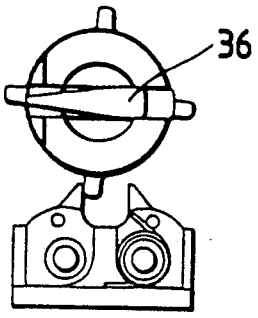

When the balls 31 received in the spirally extending groove 29 reaches the terminal end of the latter, the sleeve 26 reaches the terminal end of the slidable movement thereof as shown in FIG. 11(*a*) and FIG. 11(*b*), causing the normal rotation stopper 27 to be disengaged from the one projection 34, whereby the sleeve 26 is rotated together with the twist driving shaft 24. Since the sleeve 26 is integrated with the hook 36 as seen in the rotating direction, the hook 36 having the binding wire 2 seized thereby is rotationally driven to twist the binding wire 2. At this time, the reverse rotation stopper 28 is brought in engagement with the one projection 34 which is rotated in the so-called escaping direction.

Figure 12A:
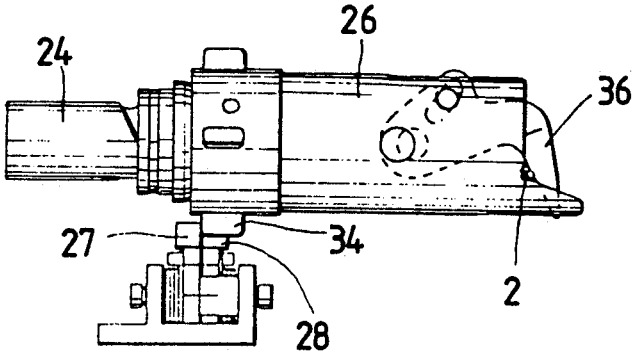
FIG. 12(*a*) is a side view of the wire twisting mechanism at the time of starting of rotation of the twist driving mechanism in the reverse direction and FIG. 12(*b*) is a front view of the wire twisting mechanism.
Figure 12B:
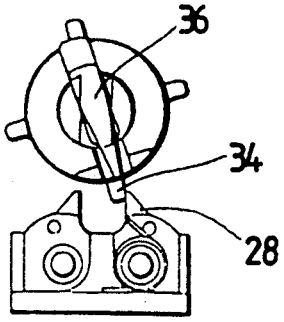
Figure 13A:
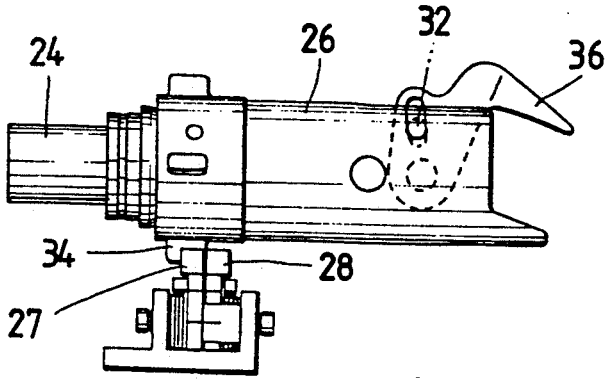
FIG. 13(*a*) is a side view of the wire mechanism at the time of opening of a hook and FIG. 11(*b*) is a front view of the wire twisting mechanism.
Figure 13B:
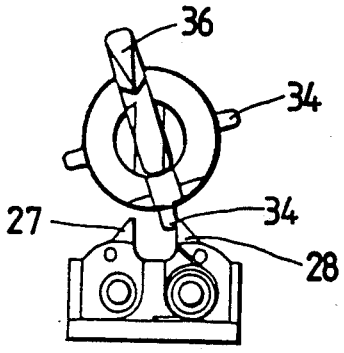
Figure 14A:
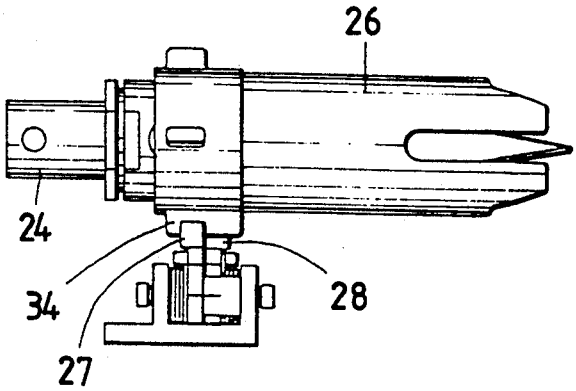
FIG. 14(*a*) is a side view of the wire twisting mechanism during return movement of the twist driving shaft and FIG. 14(*b*) is a front view of the wire twisting mechanism.
Figure 14B:
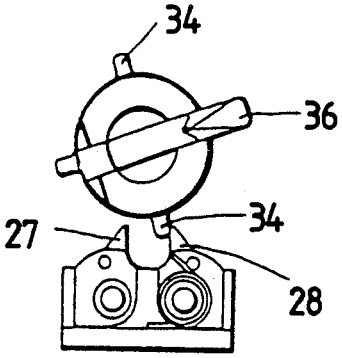

Next, as the twist driving motor 7b is activated in the reverse direction, the sleeve 26 is rotationally driven together with the twist driving shaft 24 and the twisting shaft 25 in the reverse direction but the one projection 34 on the sleeve 26 is engaged with the reverse rotation stopper 28 to prevent the latter from being in the reverse direction (see FIG. 12(a) and FIG. 12(b)). It should be noted that a plurality of projections 34 are formed on the outer peripheral surface of the sleeve 26 in the spaced relationship as seen in the circumferential direction in order to reduce a quantity of rotation of the sleeve 26 in the reverse direction. This is because if a quantity of rotation of the sleeve 26 is set to be large, there is a possibility that the twisted state of the binding wire 2 is loosened. While rotation of the sleeve 26 in the reverse direction is prevented, the sleeve 26 slidably moves in the return direction by the action of the spirally extending groove 29 and the balls 31 (see FIG. 13(a), FIG. 13(b), FIG. 14(a) and FIG. 14(b)). Since the pin 32 is displaced in the same direction at that time, the hook 36 is turnably opened to release the foremost end part of the binding wire 2 from the seized state.

Figure 15A:
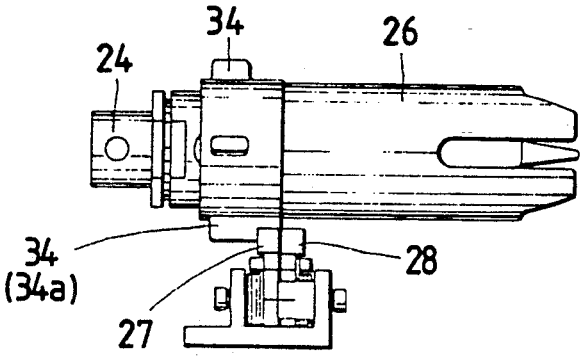
FIG. 15(*a*) is a side view of the wire twisting mechanism located at the initial position and FIG. 15(*b*) is a front view of the wire twisting mechanism.
Figure 15B:
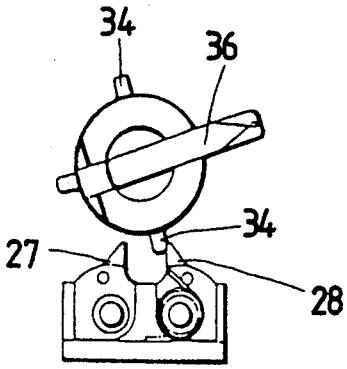

When the sleeve 26 is returned to the waiting position as shown in FIG. 15(a) and FIG. 15(b), this is detected by the return position detecting sensor 38 which in turn outputs a detection signal.

It should be noted that one of a plurality of projections 34 formed on the outer peripheral surface of the sleeve 34, i.e., a projection 34a is dimensioned to have a large length and that one short projection 34b is disengaged from the reverse rotation stopper 28 in the course of slidable movement of the sleeve 26, causing the hook 36 to be rotated again but when the reverse rotation stopper 28 is engaged with the long projection 34a, the rotation of the hook 36 is stopped. The position where the long projection 34a is engaged with the reverse rotation stopper 28 represents a normal stop position (initial position) of the hook 36.

Figure 16:
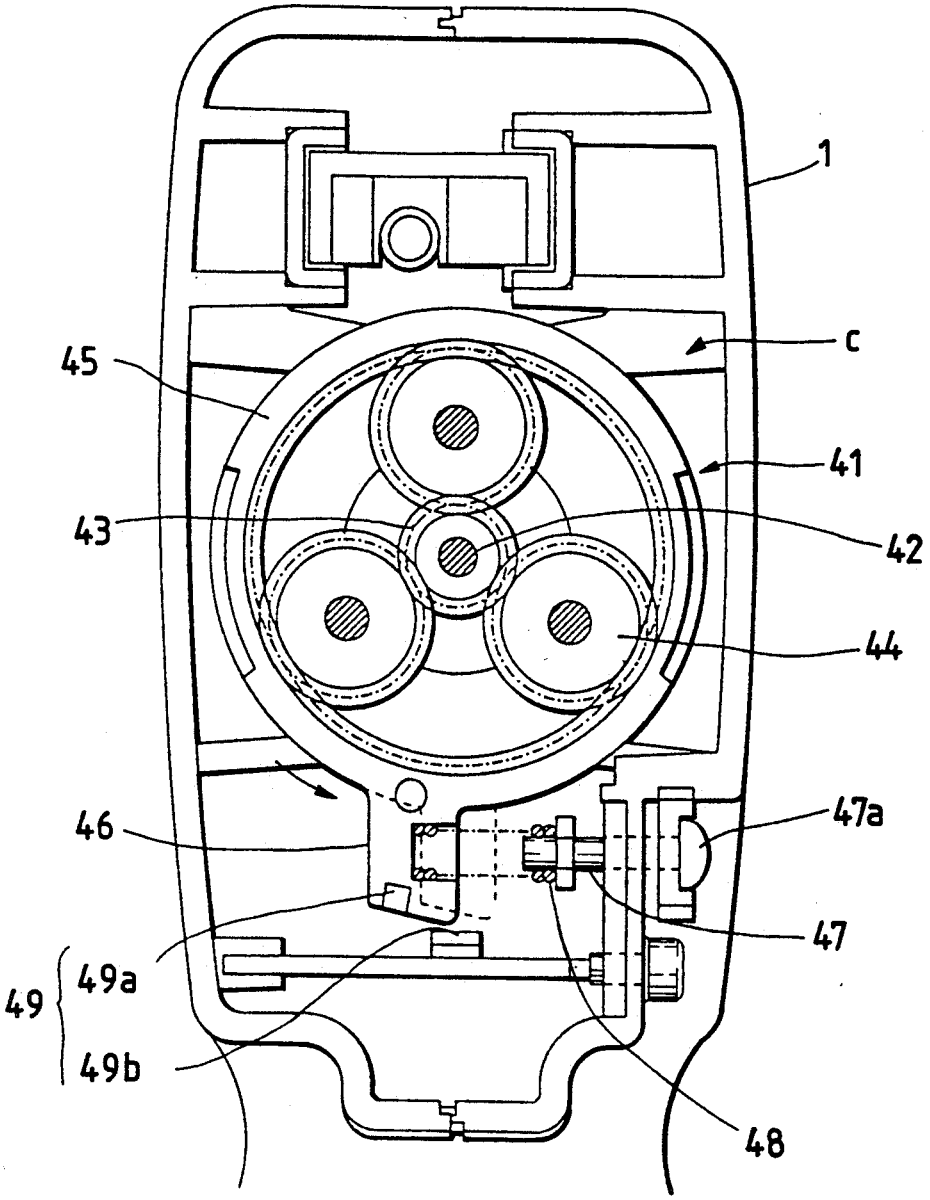
FIG. 16 is a sectional view of the wire binder taken along D—D in FIG. 1, particularly illustrating the structure of a loaded torque detecting mechanism for the wire binder.

Next, the loaded torque detecting mechanism c is actuated on receipt of a predetermined magnitude of loaded torque appearing when the wire twisting mechanism b is actuated. The loaded torque detecting mechanism c is disposed at a speed reduction mechanism 41a at a first stage, i.e., one of two-stage speed reduction mechanisms 41a and 41b arranged between the twist driving motor 7b and the wire twisting mechanism b. Specifically, as shown in FIG. 16, the speed reduction mechanism 41a consists of a sun gear 43 fixedly mounted on an output shaft 42 of the twist driving motor 7b, a plurality of planet gears 14 meshing with the sun gear 43 and an internal gear 45 arranged around the planet gears 44 while meshing with the latter. The internal gear 45 is jointed to a shaft of a sun gear 43 (not shown) of the speed reduction mechanism 41b at a second stage so that a rotational speed of the internal gear 45 is additionally reduced in the speed reduction mechanism 41b for a second stage so as to allow an amplified magnitude of rotational force to be transmitted to the twist driving shaft 24 of the wire twisting mechanism b. With this construction, the rotational speed of the output shaft 42 is largely reduced by both the speed reduction mechanisms 41a and 41b so that a large magnitude of rotational force is transmitted to the twist driving shaft 24.

The internal gear 45 in the speed reduction mechanism 41a at a first stage is rotatable in the housing 1 within a predetermined angular range, and a projection 46 radially extends from the outer peripheral surface of the internal gear 45. A coil spring 48 is bridged between the projection 46 and a spring receiving male-threaded shaft 47 threadably fitted through the side wall of the housing 1 so that the internal gear 45 is normally biased by the resilient force of the coil spring 48 in the opposite direction to the rotation of the internal gear 45. A head portion 47a of the spring receiving male-threaded shaft 47 is projected outside of the housing 1 so that the resilient force of the coil spring 48 can be adjusted by rotating the head portion 47a with an operator's hand.

In addition, a wire twisting sensor 49 is disposed between the outer peripheral surface of the internal gear 45 and the housing 1 for the purpose detecting that the internal gear 45 is rotated against the resilient force of the coil spring 48. The wire twisting sensor 49 consists of a magnet 49a and a hole element 49b, and the magnet 49 is attached to the outermost end of the projection 46, while the hole element 49b is disposed at the position corresponding to the position where the projection 46 is displaced by a predetermined distance by rotation of the projection 46 against the resilient force of the coil spring 48.

With the loaded torque detecting mechanism c constructed in the above-described manner, when the torque loaded on the twist driving shaft 24 of the wire twisting mechanism b does not reach a predetermined torque value, the internal gear 45 is not rotated at all or it is slightly rotated. In this case, the wire twisting sensor 49 does not function. When the torque loaded on the twist driving shaft 24 exceeds a predetermined value, the sun gear 43 and the planet gears 44 are rotated by the rotational force output from the twist driving motor 7b. At this time, since a predetermined magnitude of torque has been already loaded on the twist driving shaft 24, a part of the rotational force given by the planet gears 44 is transmitted to the internal gear 45, causing the latter to be rotated against the resilient force of the coil spring 48 as represented by a dotted line in FIG. 16. As the internal gear 45 is rotated, the magnet 49a attached to the outermost end of the projection 46 approaches to the hole element 49b, whereby the wire twisting sensor 49 detects that the internal gear 45 is rotated, i.e., the loaded torque detecting mechanism c is activated. Subsequently, the wire twisting sensor 49 outputs a detection signal to the controlling apparatus.

The start switch 5 is disposed on the grip side of the housing 1, and when a lever 50 is triggered with an operator's finger, the start switch 5 is turned on, causing the wire supplying motor 7a to be activated.

Next, in response to an output signal from the wire supplying sensor 18, the controlling apparatus stops rotation of the wire supplying motor 7a and rotationally drives the twist driving motor 7b in the normal direction. Subsequently, in response to an output signal from the return position detecting sensor 38 which detects that the sleeve 26 returns to the original position, the controlling apparatus stops rotation of the twist driving motor 7b. In such manner, the controlling apparatus controls one cycle of wire binding operation. It should be added that the controlling apparatus includes a microcomputer tip (not shown) as an essential component which is installed in the housing 1.

With the wire binder constructed in the above-described manner, one cycle of binding operation is performed with the binding wire 3 in the following manner. Specifically, when the lever 50 is triggered with an operator's finger to turn on the start switch 5, the wire supplying mechanism a is activated to rotationally drive the wire supplying motor 7a. As the binding wire 2 is unreeled from the bobbin mechanism 6, it is continuously supplied to the arc-shaped guide portion 4 so as to allow it to be wound around the articles 3. In response to an output signal from the wire supplying sensor 18 which detects that a predetermined length of binding wire 2 is supplied to the article 3 side, the controlling apparatus stops rotation of the wire supplying motor 7a and actuates the wire twisting mechanism b. Then., the twist driving motor 7b is rotated in the normal direction so that the hook 36 is displaced to the position where the binding wire 2 is circularly wound around the articles 3, causing a part of the binding wire 2 to be seized with the hook 36. Subsequently, as the sleeve 26 is rotated in the normal direction, the circularly wound wire 2 is tightened. When the loaded torque reaches a predetermined torque value as the binding wire 2 is tightened in that way, the loaded torque detecting mechanism c is actuated. This is detected by the wire twisting sensor 49 which in turn outputs a detection signal to the controlling apparatus. In response to the foregoing detection signal output from the wire twisting sensor 49, the controlling apparatus rotationally drives the twist driving motor 7b in the reverse direction, causing the wire twisting mechanism b to be actuated until the hook 36 returns to the waiting position. Subsequently, in response to a signal output from the return position detecting sensor 38 which detects that the wire twisting mechanism b is located at the predetermined waiting position, the controlling apparatus stops rotation of the twist driving motor 7b. Thus, the controlling apparatus completes one cycle of binding operation of the wire binder.

As is apparent from the above description, the controlling apparatus makes it possible to sequentially perform supplying of a predetermined length of binding wire, rotating of the twisting shaft until a predetermined magnitude torque value is reached, and returning of the wire twisting mechanism b to the initial position. In addition, the loaded torque detecting mechanism makes it possible that the twisting shaft is always rotated until a predetermined magnitude of loaded torque is reached, regardless of the diameter of a binding wire to be wound around a plurality of articles to be bound together. Consequently, a same binding strength can be assured regardless of the diameter of each of the articles to be bound together, and moreover, consumption of electricity can be saved without any useless driving of motors operatively associated with the controlling apparatus.

In addition, it is preferable for the wire binder of the present invention to have a bobbin mechanism 6 optionally which will be described below and shown in FIGS. 17-22.

Figure 17:
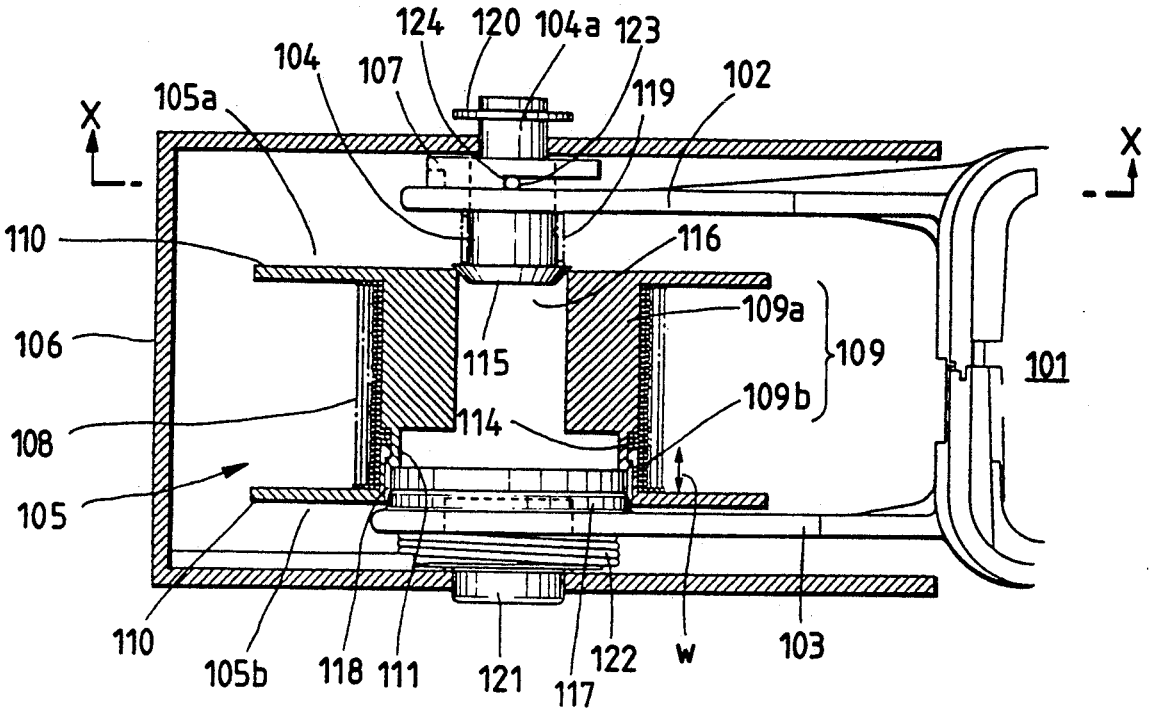
FIG. 17 is a sectional view of a bobbin mechanism for a wire binder in accordance with an embodiment of the present invention, particularly illustrating essential components constituting the bobbin mechanism.

FIG. 17 is a sectional view of a bobbin mechanism for a wire binder in accordance with an embodiment of the present invention wherein the bobbin mechanism is arranged at the rear part of the wire binder. The bobbin mechanism 6 includes as essential components a pair of brackets 102 and 103 projecting from a housing 101 of the wire binder, a support shaft 104 supported axially slidably and rotatably relative to the one bracket 102, a wire bobbin 105 rotatably supported on the support shaft 104 while locating inside of the brackets 102 and 103, a bobbin cover 106 arranged outside of the brackets 102 and 103 to cover the wire bobbin 105, and a bobbin cover lock 107 adapted to normally hold the bobbin cover 106 in the closed state.

Figure 18:
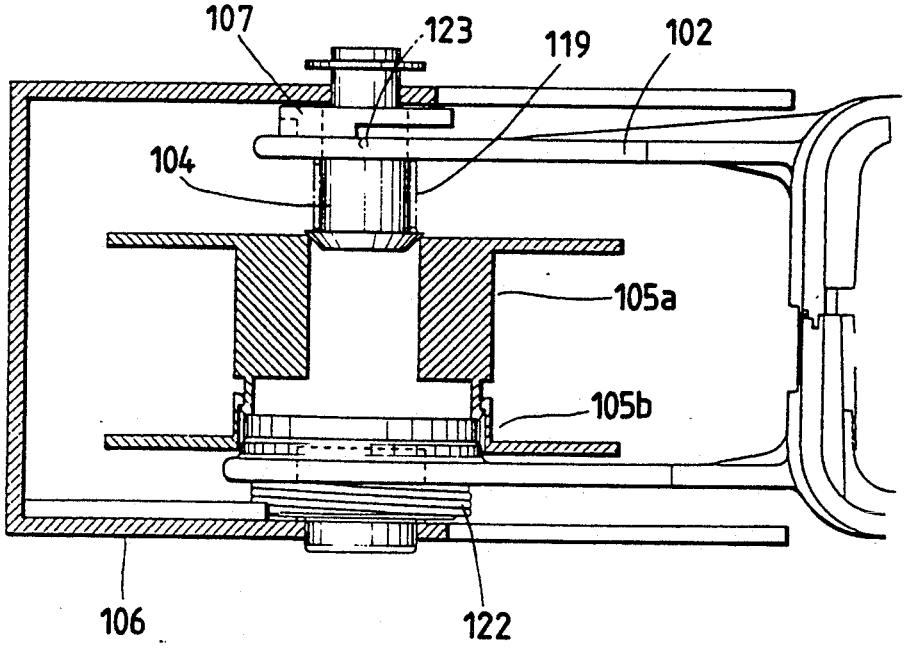
FIG. 18 is a sectional view of the bobbin mechanism shown in FIG. 17, particularly illustrating that a bobbin cover is opened by actuating the bobbin mechanism.

The wire bobbin 105 is designed in the H-shaped sectional contour such that flanges 110 are attached to the opposite ends of a wire winding sleeve 109 for winding a binding wire 108 around the latter. As is best seen in FIG. 18, the wire bobbin 105 is axially divided into two bobbin halves 5a and 5b at a right angle relative to the axial direction. A small-diametered sleeve 111 is axially projected from a wire winding sleeve 9a of one bobbin half 5a so that it is axially connectable to and disconnectable from a wire winding sleeve 9b of other bobbin half 5b. In other words, the wire bobbin 105 is constructed of two bobbin halves 5a and 5b in the aforementioned connected state. The wire winding sleeve 9b of the other bobbin half 5b is designed to have a length long enough to allow the binding wire 108 to be wound therearound by at least one turn. It should be noted that the end edge of the small diametered sleeve 111 of the wire winding sleeve 9a of the one bobbin half 5a is operatively engaged with the end edge of the wire winding sleeve 9b of the other bobbin half 5b so that the former is not separated from the latter.

The binding wire 108 is closely wound around the wire bobbin 105 between both the flanges 110 in the side-by-side relationship while the bobbin halves 5a and 5b are operatively connected to each other. A part of the binding wire 108 is wound around an annular groove 114 on the small-diametered sleeve 111 of the one bobbin half 5a so that the bobbin halves 5a and 5b are held on the support shaft 104 in the axially slightly separated state. A part w of the binding wire 108 on the start end side subsequent to the part of the binding wire 108 wound around the annular groove 114 is wound around the wire winding sleeve 9b of the other bobbin half 5b by a length required for winding the binding wire 108 around the wire winding sleeve 9b by at least one turn.

Figure 22:
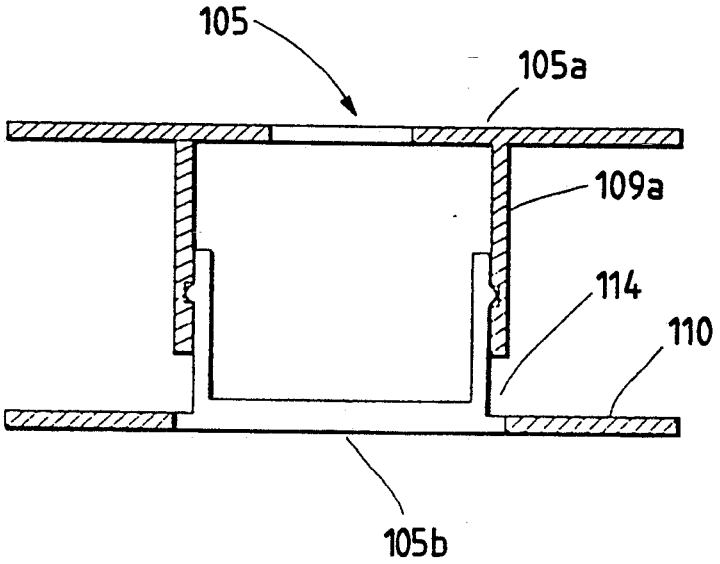
FIG. 22 is a sectional view of a wire bobbin for the bobbin mechanism in accordance with another embodiment of the present invention, particularly illustrating the wire bobbin composed of two bobbin halves in a different manner.

Alternatively, as shown in FIG. 22, the annular groove 114 on the wire bobbin 105 may be formed between the foremost end of a winding sleeve 9a of the one bobbin half 5a and the flange 110 of the other bobbin half 5b. In this case, it is recommendable that the starting end part of the winding wire 108 is wound around the annular groove 114 by a length required for winding the binding wire 108 around the annular groove 114 by at least two turns.

The bobbin 105 is arranged inside of the pair of brackets 102 and 103 and rotatably supported with the aid of the brackets 102 and 103 and a support shaft 104 to be described later. The support shaft 104 is designed in the form of a short shaft and arranged inside of the one bracket 102 to be rotatably and movable in the axial direction. It should be added that one outer end 4a of the support shaft 104 is designed to exhibit a non-circular sectional contour (see FIG. 19). In addition, the support shaft 104 includes an engagement edge 115 at the inside end thereof in the X projected state so that the engagement edge 115 is engaged with an engagement hole 116 formed at the central part on the outer side wall of the bobbin half 5a. On the other hand, a cylindrical engagement projection 117 is formed inside of the other bracket 103 in the concentrical relationship relative to the support shaft 104 so that it is engaged with an engagement hole 118 formed at the central part on the inner side wall of the bobbin half 5a. With this construction, the wire bobbin 105 can rotatably be supported by the support shaft 104 and the engagement projection 117.

A compression spring 119 is disposed between the bracket 102 and the annular projection around the engagement edge 115 of the support shaft 104. Thus, the support shaft 104 is normally biased by the resilient force of the compression spring 119 in such a direction that both the bobbin halves 5a and 5b come nearer to each other, whereby the support shaft 104 can axially be displaced in conformity with the displacement of the bobbin half 5a toward or away from the bobbin half 5b in the axial direction. It should be noted that a disconnection preventive piece 120 is fixedly secured to the outer end of the support shaft 104 in order to prevent the support shaft 104 from being disconnected from the bobbin cover 106.

Figure 19:
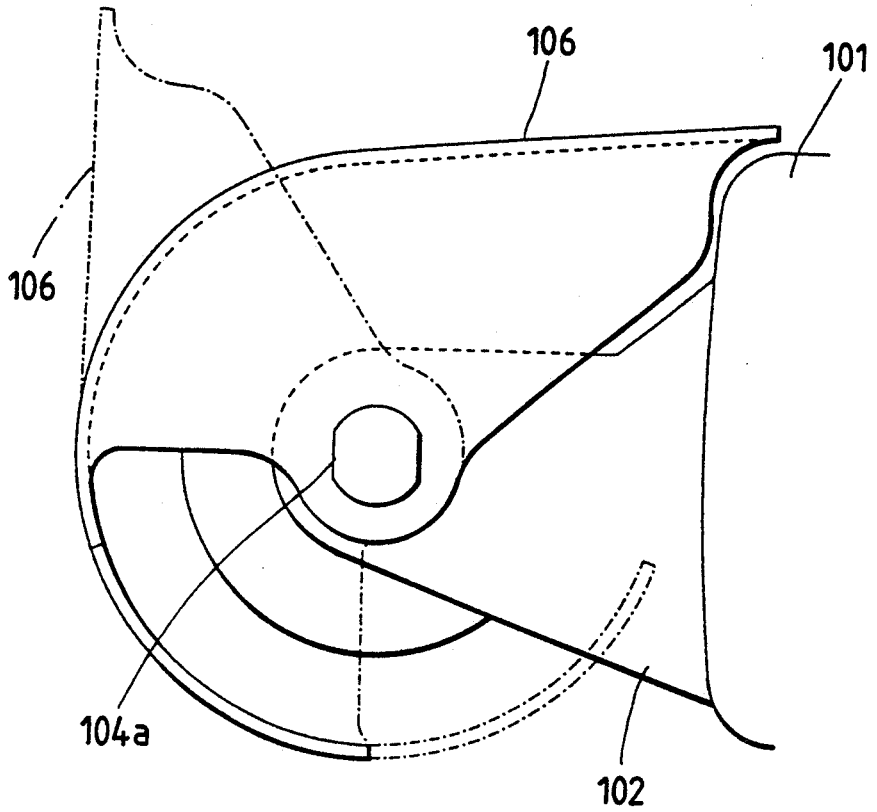
FIG. 19 is a side view of the bobbin mechanism, particularly illustrating how the bobbin cover is turnably mounted on a support shaft.

The bobbin cover 106 is designed to have a substantially U-shaped cross-sectional contour. As shown in FIG. 19, one side wall of the bobbin cover 106 is fitted onto the non-circular end 4a of the support shaft 104 so as to allow it to be supported integral with the support shaft 104 to turn in the direction of rotation of the latter, while the other side wall of the same is rotatably supported on a short shaft piece 121 disposed in the concentrical relationship relative to the engagement projection 117 to freely turn about the short shaft piece 121. The support shaft 104 is rotatable together with the bobbin cover 106, and moreover, it is movable in the axial direction. A coil spring 122 is wound around the short shaft piece 121 such that one end of the same is engaged with the bracket 103 and other end of the same is engaged with the bobbin cover 106, whereby the bobbin cover 106 is normally biased by the resilient force of the coil spring 122 in the opening direction.

Figure 20:
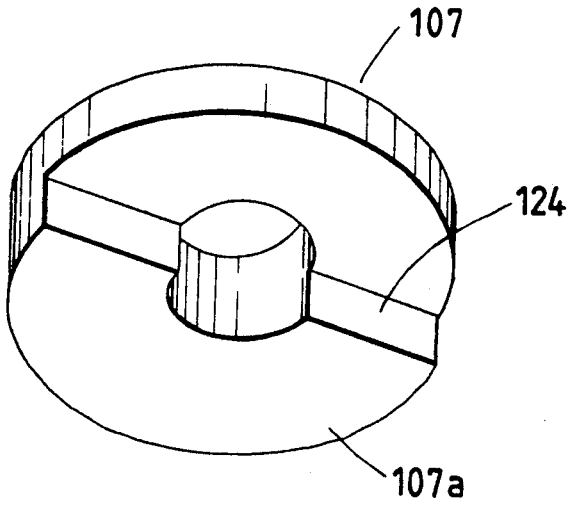
FIG. 20 is a perspective view of a bobbin cover lock for the bobbin mechanism.

The bobbin cover 106 is locked by a bobbin cover lock 107 in the closed state. As shown in FIG. 20, the bobbin cover lock 107 is designed such that one half 7a of a short cylindrical member has a heavy thickness. Specifically, the support shaft 104 extends through one side wall of the bobbin cover 106 and the bracket 102, and the bobbin cover lock 107 is fixedly secured to the bracket 102 while the heavy thickness portion 7a thereof is located inside of the bracket 102. In addition, as shown in FIG. 18, a pin-shaped engagement portion 123 is projected from the outer peripheral surface of the support shaft 104. The engagement portion 123 is disposed at the position where it can be engaged with a stepped surface 124 extending at a right angle relative to the heavy thickness portion 7a of the bobbin cover lock 107. When the support shaft 104 is axially squeezed out against the resilient force of the compression coil spring 119 while both the bobbin halves 5a and 5b of the wire bobbin 105 are parted away from each other, the engagement portion 123 is brought in engagement with the bobbin cover lock 107. At this time, the bobbin cover 106 is held in the closed state.

Figure 21:
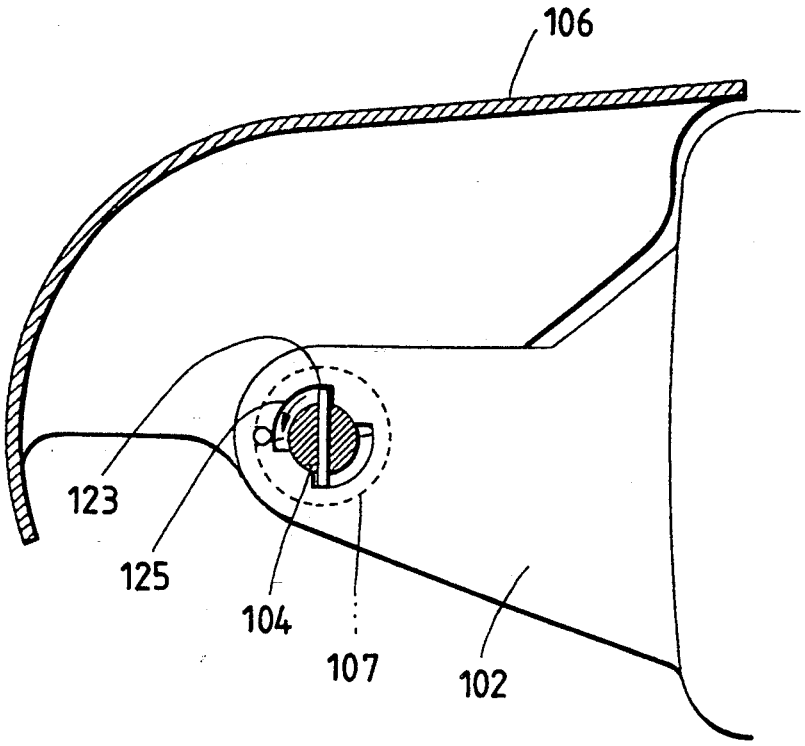
FIG. 21 is a sectional view of the bobbin mechanism taken along line X—X in FIG. 1.

As shown in FIG. 21, the bracket 102 is formed with a cutout 125 (alternatively, a recessed portion) at the position corresponding to the bobbin cover lock 107 in order to assure that the cutout 125 receives the engagement portion 123 when the support shaft 104 is axially displaced in the inward direction. The cutout 125 is formed to such an extent that the bobbin cover 106 can be rotated in the opening direction when the support shaft 104 is rotated by a substantially right angle.

With the bobbin mechanism constructed in the above-described manner, the engagement portion 123 projecting from the support shaft 104 is normally engaged with the stepped surface 124 of the bobbin cover lock 107 without any necessity for rotation of the support shaft 104. Thus, the bobbin cover 106 is usually kept closed. When a binding operation is to be practically performed, a binding wire 108 wound around the wire bobbin 105 is delivered from an outlet port 136 of the arc-shaped guide 136 as a wire supplying mechanism 133 in the housing 101 is actuated. After it is wound around a plurality of articles to be bound, it is cut off from the subsequent binding wire by actuating a cutter mechanism 135, and thereafter, the foremost end of the cut binding wire 108 is twisted by rotating a twisting shaft 134 until the articles are bound together with the binding wire 108. As the aforementioned binding operation is repeatedly performed, the binding wire 108 wound around the wire bobbin 105 is successively unreeled and increasingly consumed. When a final turn of the binding wire 108 wound around the annular groove 114 of the small-diametered cylindrical portion 111 of the one bobbin half 5a as shown in FIG. 17 is consumed, both the bobbin halves 5a and 5b are released from the expanded state given by the wound wire 108 with the result that they come near to each other under the effect of the resilient force of the compression coil spring 119 as shown in FIG. 18. This causes the support shaft 104 to be axially displaced in the inward direction, resulting in the engagement portion 123 being displaced in the same direction until it is received in the cutout 125 on the bracket 102 (see FIG. 21). At this time, the engagement portion 123 is disengaged from the bobbin cover lock 107, enabling the support shaft 104 to be rotated, whereby the bobbin cover 106 is turned in the opening direction by the resilient force of the coil spring 122 (as represented by dotted lines in FIG. 19). As the bobbin cover 106 is turned, the engagement portion 123 projecting from the support shaft 104 collides with the opposite end of the cutout 125 to inhibit the bobbin cover 106 from being turned further. Consequently, the bobbin cover 106 is kept opened at the position corresponding the opposite end of the cutout 125.

As is apparent from the above description, when the remaining quantity of binding wire 108 is very largely reduced, the bobbin cover 106 turns about the support shaft 104 in the opening direction. After completion of a final binding operation, an operator can visually recognize that the wire bobbin 105 has no remaining quantity of binding wire 108. Subsequently, when the operator stops his work, there is no possibility that a part of the binding wire 108 remains in the region extending between the cutter mechanism 135 and the outlet port 136 of the arc-shaped guide 131. There sometimes arises an occasion that the terminal end of the binding wire 108 remains in the annular groove 114 of the wire bobbin 105, causing the support shaft 104 to be insufficiently displaced in the axial direction, resulting in the bobbin cover 106 failing to be turnably opened. This means that a final turn of the binding wire 108 remains around the cylindrical winding portion 9b of the other bobbin half 5b of the wire bobbin 105. In this case, after completion of the final binding operation, the operator turnably opens the bobbin cover 106 by himself so as enable him to visually recognize that no binding wire remains on the wire bobbin 105. Consequently, there does not arise a malfunction that a part of the binding wire 108 remains in the region between the cutter mechanism 136 and the outlet port 136 of the arc-shaped guide 131.

Figure 23:
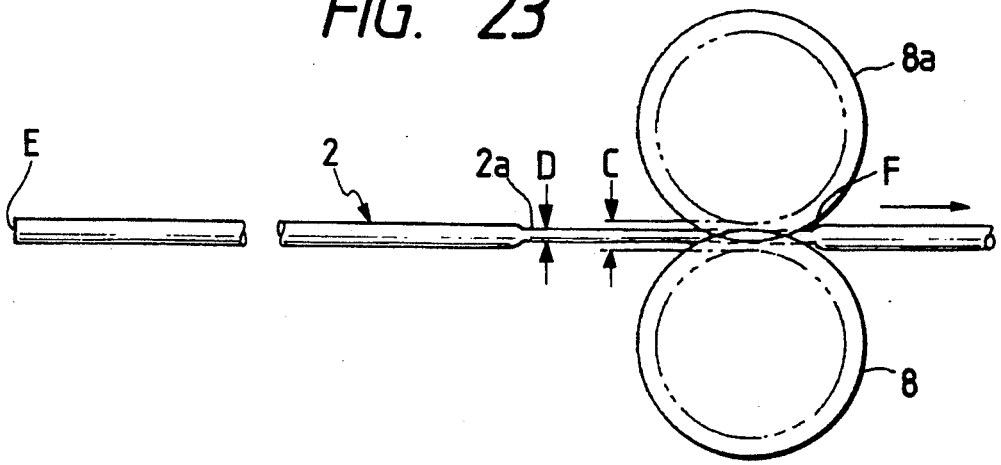
FIG. 23 is a plane of the wire with the wire supplying rollers of the further another embodiment of the present invention.

FIG. 23 shows a portion adjacent to an end E of binding wire 2 which may be employable for the wire binder of an embodiment of the present invention. The end E of the binding wire 2 is fixedly connected to a reel R of the bobbin mechanism and the binding wire 2 is wound on the reel R. The portion adjacent to the end E is formed into a small diametered portion 2*a* by a drawing means or the like in such a manner that a diameter of the small diametered portion 2*a* is smaller than an inner diameter of a wire clamping chamber defined between the wire supporting roller 8 and the movable wire supporting roller 8*a*. Thereby, when the small diametered portion 2*a* is reached between the rollers 8 and 8*a* after the binding wire 2 is continuously supplied and is spent, it becomes impossible to clamp the small diametered portion 2*a* with the rollers 8 and 8*a*, so that the supplying operation of the binding wire 2 is stopped even if the rollers 8 and 8*a* are rotated.

Figure 24:
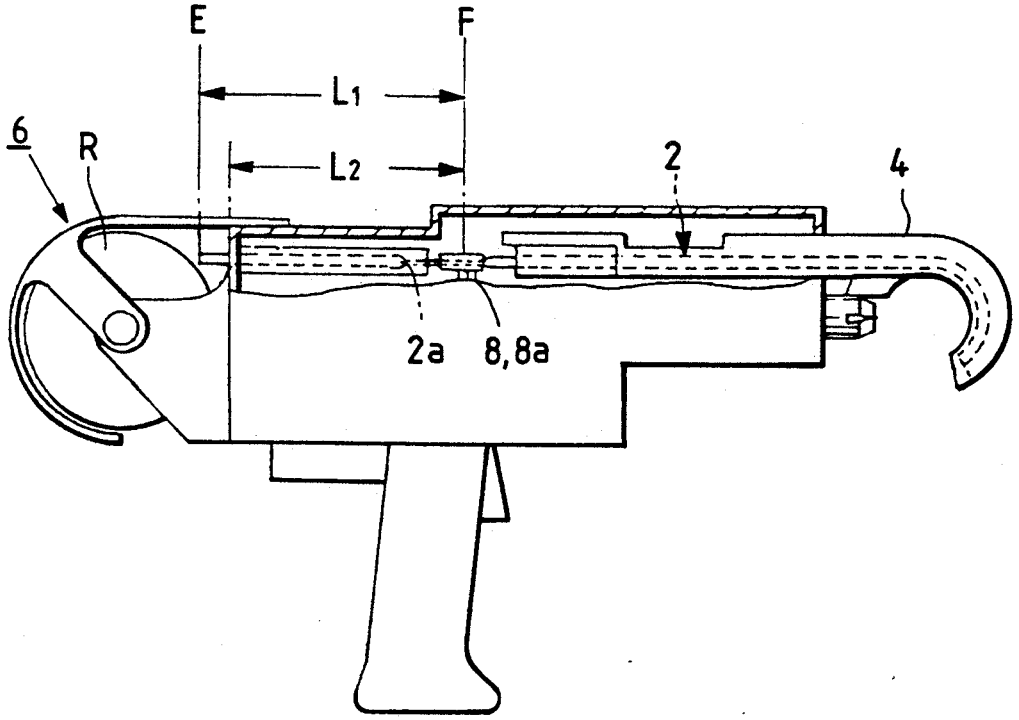
FIG. 24 is a partial sectional view showing the wire of the same mounted in a binder.

In addition, as shown in FIG. 24, a distance $L_1$ from a fore end F of the small diametered portion 2*a* to the end E of the binding wire 2 set to be smaller than a distance $L_2$ between a contact position of the rollers 8 and 8*a* and a wire insertion hole 1*a* opened on the end surface of the house 1, so that the end I of the binding wire 2 is never entered into the wire insertion hole 1*a* due to the small diametered portion 2*a* is reached and remained between the rollers 8 and 8*a*.

In the case where the movement of the binding wire 2 is stopped by reaching the small diametered portion 2*a* to a position between the rollers 8 and 8*a* during a binding operation, the binding operation of the wire binder is still continued until one cycle operation of the wire binder is completed. In this one cycle operation, the binding wire is cut by the shearing cutter 19 of the cutting mechanism formed on the fore end of the liner guide portion 9. Accordingly, it is possible to eliminate a remained binding wire disposed within the liner guide portion 9 easily in such a manner that the remained binding wire is pulled out toward the side of the end E of the binding wire.

Figure 25:
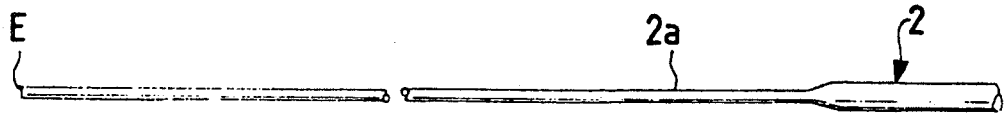
FIG. 25 is a plane view of the modified wire of the further another embodiment.

Further, as shown in shown in FIG. 25, it is also possible to modify the small diametered portion 2*a* of the wire 2 in such a manner that the small diametered portion 2*a* is extended to the end E.

With the above-mentioned wire structure, it is possible to stop the movement for supplying the wire automatically and surely before the end of the binding wire is entered into the inside of the winding binder. Since the remained wire near the end can be easily eliminated, it is not necessary to disassemble the binder or the wire guiding mechanism to eliminate the same.

In addition, in the conventional wire, it was required to conduct the binding operation of the binder while an remaining amount of the wire wound on the reel R is watched to prevent the end of the binding wire from entering into the inside of the binder. However, by using the wire having the small diametered portion according to the present invention, it becomes not necessary to watch or check the remaining amount. Since such a problem of the conventional wire is never occurred, it is possible to improve an operating efficiency and a handling ability.

While the present invention has been described above with respect to a single preferred embodiment thereof, it should of course be understood that the present invention should not be limited only to this embodiment but various change or modification may be made without departure from the scope of the present invention as defined by the appended claims.

What is claimed is:

1. A wire binder comprising:

a wire supplying means for continuously supplying a predetermined length of a binding wire wound on a bobbing mechanism;

a wire guiding means for guiding the movement of said binding wire so as to allow said binding wire to be circularly wound about a plurality of articles to be bound;

a wire cutting means for cutting said guided binding wire;

a wire twisting means for seizing and twisting a part of said binding wire so as to allow circularly wound wire to be tightened;

a twisting torque detecting means for detecting a loaded torque of said wire twisting means, said twisting torque detecting means including a twist sensor being actuated on receipt of a predetermined magnitude of the loaded torque when said binding wire is twisted by said wire twisting means; and a controlling means for controlling the movement of said wire twisting means in response to an output of said twisting torque detecting means in such a manner that said binding wire is subjected to said predetermined magnitude of the loaded torque of said wire twisting means.

2. A wire binder according to claim 1, in which said wire guiding means includes a linear guide portion for linearly guiding the movement of said binding wire and an arch-shaped guide portion for allowing said binding wire to be circularly wound about side articles to be bound, said wire supplying means includes a wire supplying mechanism for continuously supplying said binding wire to said arc-shaped guide portion which serves to guide the movement of said binding wire with the aid of a wire supplying roller adapted to be rotationally driven by a wire supplying motor;

said wire twisting means includes a wire twisting mechanism for seizing and twisting a part of said binding wire with a hook displaced to the position where said binding wire is circularly wound around said articles when said wire supplying roller is rotated in the normal direction, and for displacing said hook away from the foregoing position to a waiting position to release said binding wire from the seized state when said wire supplying roller is rotationally driven in the reverse direction, said twisting torque detecting means including a loaded torque detecting mechanism disposed between a twist driving motor and a wire twisting mechanism, said loaded torque detecting mechanism being actuated on receipt of a predetermined magnitude of loaded torque when said binding wire is twisted by said wire twisting mechanism, a start switch adapted to be manually actuated to activate said wire supplying motor is further provided, and said controlling means controls one cycle of binding operation to be performed by said wire binder, said controlling means includes a wire supplying sensor for detecting a predetermined number of rotations of said wire supplying roller and a return position detecting sensor for detecting that said wire twisting mechanism is located at a predetermined waiting position, wherein in response to an output signal from said wire supplying sensor, said control means stops rotation of said wire supplying motor and rotationally drives said twist driving motor in the normal direction, in response to an output signal from said wire twisting sensor, said control means shifts rotation of said twist driving motor in the normal direction to rotation of the same in the reverse direction, and in response to an output signal from said return position detecting senor, said control means stops rotation of said twist driving motor in the reverse direction.

3. A wire binding according to claim 1 further including a speed reduction mechanism comprising:

a sun gear fixedly mounted on an output shaft of a twist driving motor;

a plurality of planet gears each meshing with said sun gear; and an internal gear arranged around said planet gears so as to allow a rotational speed of said output shaft of said driving motor to be reduced in order to twist said binding wire at the reduced rotational speed, in which said twisting torque detecting means includes a mechanism for detecting twist torque appearing on a binding wire in operative association with said speed reduction mechanism, said internal gear is arranged to be rotatable in a housing within the range defined by a predetermined angle, said internal gear is normally biased by a spring which can adjustably be actuated from the outside in such a direction that torque is exerted on said internal gear when the latter is driven in a predetermined direction, said twist sensor is arranged between the outer peripheral surface of said internal gear and said housing so as to detect that said interior gear has been rotated against the biasing force of said spring, and said control means is arranged for the purpose of stopping rotation of said driving motor in response to a signal output from said twist sensor.

4. A wire binder according to claim 1, in which said wire guiding means includes a liner guide portion for linearly guiding the movement of said binding wire and an arch-shaped guide portion for allowing said binding wire to be bound, wherein said linear guide portion is disposed on the front side relative to said wire supplying means for successively supplying a long binding wire in the forward direction, and said arc-shaped guide portion of which fore end is bent in the arc-shaped contour is disposed downstream of said linear guide portion, said binding wire discharged from the foremost end of said arc-shaped guide portion is wound around said articles to be bound by several turns.

5. A wire binder according to claim 4, wherein said wire cutting means includes a cutting mechanism for cutting said binding wire which is disposed at a predetermined position between said linear guide portion and said arc-shaped guide portion.

6. An wire binder according to claim 5, wherein said arc-shaped guide portion is constructed of a side plate portion of which fore part is bent in the arc-shaped contour and a movable member having an arc-shaped groove recessed on a surface located opposite to one side surface of said side plate portion, said movable member is displaceable away from said side plate portion and normally biased toward sand side plate portion by the resilient force of a spring, and an inclined surface adapted to be engaged with said binding wire in said arc-shaped groove is formed at the fore end part of said movable member in such a manner as to allow said movable member to be parted away from said side plate portion.

7. A wire binder according to claim 1, in which said wire seizing and twisting means includes a twisting drive shaft operatively connected to a twisting drive motor via a speed reduction mechanism being jointed to a twisting shaft disposed forward of said twisting drive shaft so as to allow both the shafts to be rotated on a common axis separately from each other, a spirally extending groove is formed on the outer peripheral surface of said twisting drive shaft, the base end part of a hook is openably supported on said twisting shaft, and a sleeve is arranged across the outer peripheral surfaces of said twisting drive shaft and said twisting shaft in such a manner as to rotate relative to said twisting drive shaft, and moreover, slidably move in the axial direction relative to said twisting shaft, wherein a ball receiving portion of which part is fitted onto said spirally extending groove on said twisting drive shaft is formed on the inner surface of said sleeve, and a pin loosely received in an elongated hole formed at the central part of said hook is disposed on the fore end side of said sleeve, a plurality of projections are formed on the outer peripheral surface of said sleeve in the circumferential direction, and a normal rotation stopper for preventing said sleeve from being rotated in the normal direction when said projections are engaged with said normal rotation stopper and a reverse rotation stopper for preventing said sleeve from being rotated in the reverse direction when said projections are engaged with said reverse rotation stopper are arranged in the vicinity of the outer peripheral surface of said sleeve, when said twisting driving shaft is rotated in the normal direction, said projections are engaged with said normal rotation stopper so that rotation of said sleeve located at the initial position in the normal direction is prevented, said sleeve slidably moves along said spirally extending groove of said twisting drive shaft together with a plurality of balls in the forward direction to turn said sleeve in the direction of closing of said hook, and when said sleeve reaches the end position of slidable movement thereof, said projections are released from the engaged state relative to said normal rotation stopper so as to allow said sleeve and said twisting drive shaft to be rotated together in the normal direction, and when said twisting drive shaft is rotated in the reverse direction, said projections are engaged with said reverse rotation stopper so as to allow said sleeve to slidably move to the initial position.

8. A wire binder according to claim 1, in which said bobbin mechanism comprises:

a pair of brackets each projecting from a housing of said wire binder;

a support shaft rotatably supported to be rotated relative to the one bracket, said support shaft being slidably displaceable in the axial direction;

a wire bobbin rotatably supported on said support shaft inside of said brackets;

a bobbin cover of which one side wall is turnably supported to turn about said support shaft together with the latter in the rotating direction and of which other side wall is turnably supported by the other bracket to turn in the opening direction by the resilient force of a coil spring; and a bobbin cover lock adapted to be engaged with and disengaged from an engagement portion projecting from said support shaft, said bobbin cover lock serving to hold said bobbin cover at the closed position when it is engaged with said engagement portion, wherein said wire bobbin is divided into two bobbin halves at a right angle relative to the axial direction, said bobbin halves are connected to each other in such a manner as to axially move to come near to each other and part away from each other, said bobbin halves are normally biased by the resilient force of another coil spring in such a direction that they come near to each other, said bobbin halves are held in the parted state when a binding wire is closely wound around said wire bobbin, and said bobbin halves are displaced to come near to each other by the resilient force of said coil spring when a part of said binding wire having a length corresponding to a final binding operation is unreeled from said wire bobbin, resulting in the parted state of said bobbin halves being canceled, and said support shaft is displaced in the axial direction as said bobbin halves come near to each other and move away from each other, said engagement portion is engaged with said bobbin cover lock when said bobbin halves are held in the parted state, and said engagement portion is disengaged from said bobbin cover lock when said bobbin halves come near to each other, causing said bobbin cover to be turned in the opening direction.

9. A wire binder according to claim 1, in which said binding wire is integrally provided with a small diametered portion having a diameter smaller than the other portion in such a manner that the binding wire is not supplied when the smaller diametered portion is reached within said supplying means.

* * * * *